US010904676B2

(12) United States Patent
Lim et al.

(10) Patent No.: US 10,904,676 B2
(45) Date of Patent: Jan. 26, 2021

(54) ULTRASONIC HEARING SYSTEM AND RELATED METHODS

(71) Applicant: REGENTS OF THE UNIVERSITY OF MINNESOTA, Minneapolis, MN (US)

(72) Inventors: Hubert H. Lim, Minneapolis, MN (US); Mark Hamilton, Minneapolis, MN (US); Hongsun Guo, Minneapolis, MN (US); Cory Gloeckner, Minneapolis, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 0 days.

(21) Appl. No.: 16/414,118

(22) Filed: May 16, 2019

(65) Prior Publication Data

US 2019/0342675 A1 Nov. 7, 2019

Related U.S. Application Data

(63) Continuation of application No. 15/581,714, filed on Apr. 28, 2017, now Pat. No. 10,362,415.
(Continued)

(51) Int. Cl.
*H04R 25/00* (2006.01)

(52) U.S. Cl.
CPC ..... *H04R 25/45* (2013.01); *H04R 25/48* (2013.01); *H04R 25/606* (2013.01); *H04R 25/43* (2013.01)

(58) Field of Classification Search
None
See application file for complete search history.

(56) References Cited

U.S. PATENT DOCUMENTS 4,419,544 A 12/1983 Adelman
4,982,434 A 1/1991 Lenhardt et al.
(Continued)

FOREIGN PATENT DOCUMENTS

DE 102015106560 11/2016
JP 2002300700 A 10/2002
RU 2134092 8/1999

OTHER PUBLICATIONS

Aitkin, L.M., et al. (1981). The representation of the auditory and somatosensory systems in the external nucleus of the cat inferior colliculus. J. Comp. Neurol. 196, 25-40.
(Continued)

*Primary Examiner* — James K Mooney
(74) *Attorney, Agent, or Firm* — Quarles & Brady LLP

(57) ABSTRACT

A hearing system to activate an auditory system using cerebrospinal fluids includes at least one processor configured to receive an audio signal captured using a sound sensor (e.g., a microphone), extract temporal and spectral features from the audio signal, and create modulated ultrasound signals in a range of 20 Hz to 20 kHz with ultrasound carrier frequencies in the range of 50 kHz to 4 MHz, which are ultrasound frequencies that are well-suited to reach the cerebrospinal fluids (e.g., can pass across the skull/bones to reach the cerebrospinal fluids). The system further includes at least one ultrasonic transducer which receives the modulated signal and delivers the modulated signal to the body and activates the auditory system via vibration of cerebrospinal fluids that vibrate cochlear fluids, bypassing the normal conductive pathway that uses middle ear bones and minimizing bone conduction and distortion through the skull.

22 Claims, 26 Drawing Sheets

Related U.S. Application Data

(60) Provisional application No. 62/329,804, filed on Apr. 29, 2016.

(56) References Cited

U.S. PATENT DOCUMENTS

| | | | |
|---|---|---|---|
| 5,285,499 | A | 2/1994 | Shannon et al. |
| 6,068,590 | A | 5/2000 | Brisken |
| 6,169,813 | B1 | 1/2001 | Richardson et al. |
| 6,173,062 | B1 | 1/2001 | Dibachi et al. |
| 6,217,508 | B1 | 4/2001 | Ball et al. |
| 6,377,693 | B1 | 4/2002 | Lippa et al. |
| 6,394,969 | B1 | 5/2002 | Lenhardt |
| 6,577,739 | B1 | 6/2003 | Hurtig et al. |
| 6,631,196 | B1 | 10/2003 | Taenzer et al. |
| 6,631,197 | B1 | 10/2003 | Taenzer |
| 6,731,769 | B1 | 5/2004 | Lenhardt |
| 7,088,224 | B2 | 8/2006 | Nakagawa et al. |
| 8,107,647 | B2 | 1/2012 | Lenhardt |
| 8,189,839 | B2 | 5/2012 | Lenhardt et al. |
| 8,571,242 | B2 | 10/2013 | Bachler et al. |
| 8,929,575 | B2 | 1/2015 | Norris |
| 9,621,973 | B2 | 4/2017 | Stauber et al. |
| 10,039,672 | B2 | 8/2018 | Aghamohammadi |
| 10,631,103 | B2 | 4/2020 | Lim |
| 2001/0051776 | A1 | 12/2001 | Lenhardt |
| 2004/0196998 | A1 | 10/2004 | Noble |
| 2004/0202339 | A1 | 10/2004 | O'Brien |
| 2005/0201574 | A1 | 9/2005 | Lenhardt |
| 2011/0158444 | A1 | 6/2011 | Waldmann |
| 2012/0053391 | A1 | 3/2012 | Mishelevich |
| 2014/0355800 | A1 | 12/2014 | Kang |
| 2015/0126802 | A1 | 5/2015 | Lim et al. |
| 2016/0249138 | A1 | 8/2016 | Van Der Werf |
| 2016/0269833 | A1 | 9/2016 | Norris et al. |
| 2016/0337750 | A1 | 11/2016 | Louis |
| 2017/0318397 | A1 | 11/2017 | Lim et al. |
| 2018/0117328 | A1 | 5/2018 | Herrmann |

OTHER PUBLICATIONS

Brunoni, A.R., et al. (2011). A systematic review on reporting and assessment of adverse effects associated with transcranial direct current stimulation. Int. J. Neuropsychopharmacol. 14, 1133-1145.

Bystritsky, A., et al. (2011). A review of low-intensity focused ultrasound pulsation. Brain Stimulat. 4, 125-136.

Bystritsky, A., et al. (2015). A review of low-intensity transcranial focused ultrasound for clinical applications. Curr. Behav. Neurosci. Rep. 2, 60-66.

Clemo, H.R., et al. (2007). Auditory projections to visual cortex: synaptic basis for multisensory processing in unimodal visual neurons. J. Vis. 7, 864-864.

Davis, M. (1970). Effects of interstimulus interval length and variability on startle-response habituation in the rat. J. Comp. Physiol. Psychol. 72, 177-192.

Deng, Z.-D., et al. (2013). Electric field depth-focality tradeoff in transcranial magnetic stimulation: simulation comparison of 50 coil designs. Brain Stimulat. 6, 1-13.

Foxe, J.J., et al. (2000). Multisensory auditory-somatosensory interactions in early cortical processing revealed by high-density electrical mapping. Brain Res. Cogn. Brain Res. 10, 77-83.

Fry, F.J., et al. (1958). Production of reversible changes in the central nervous system by ultrasound. Science 127, 83-84.

Fukushima, Ariko, et al. "Frequencies of inaudible high-frequency sounds differentially affect brain activity: positive and negative hypersonic effects." PloS one 9.4 (2014): e95464.

Geyer, M.A., et al. (2001). Measurement of startle response, prepulse inhibition, and habituation. Curr. Protoc. Neurosci. Chapter 8, 8.7.1-8.7.15.

Glowa, J.R., et al. (1994). Differences in response to an acoustic startle stimulus among forty-six rat strains. Behav. Genet. 24, 79-84.

Gopen, Q., et al. (1997). Anatomy of the normal human cochlear aqueduct with functional implications. Hear. Res. 107, 9-22.

Grimsley, C.A., et al. (2015). An improved approach to separating startle data from noise. J. Neurosci. Methods 253, 206-217.

Gruters, K.G., et al. (2012). Sounds and beyond: multisensory and other non-auditory signals in the inferior colliculus. Front. Neural Circuits 6, 96.

Guo, Hongsun, et al. "Ultrasound produces extensive brain activation via a cochlear pathway." Neuron 98.5 (2018): 1020-1030.

Hallett, M. (2000). Transcranial magnetic stimulation and the human brain. Nature 406, 147-150.

Huang, C.L., et al. (2000). Auditory thalamocortical projections in the cat: laminar and areal patterns of input. J. Comp. Neurol 427, 302-331.

Ito, K., et al. (2010). Perception mechanisms of bone-conducted ultrasound assessed by acoustic characteristics in the external auditory meatus. Jpn. J. Appl. Phys. 49, 07HF31.

Johnson, M.D., et al. (2013). Neuromodulation for brain disorders: challenges and opportunities. IEEE Trans. Biomed. Eng. 60, 610-624.

King, R.L., et al. (2013). Effective parameters for ultrasound-induced in vivo neurostimulation. Ultrasound Med. Biol. 39, 312-331.

King, R.L., et al. (2014). Localization of ultrasoundinduced in vivo neurostimulation in the mouse model. Ultrasound Med. Biol. 40, 1512-1522.

Kubanek, J., et al. (2016). Ultrasound modulates ion channel currents. Sci. Rep. 6, 24170.

Lee, W., et al. (2015). Image-guided transcranial focused ultrasound stimulates human primary somatosensory cortex. Sci. Rep. 5, 8743.

Lee, W., et al. (2016). Transcranial focused ultrasound stimulation of human primary visual cortex. Sci. Rep. 6, 34026.

Legon et al., "Transcranial focused ultrasound modulates the activity of primary somatosensory cortex in humans", Nat Neurosci, vol. 17, No. 2, pp. 322-329, Feb. 2014.

Legon et al., "Transcranial focused ultrasound neuromodulation of the human primary motor cortex", (2018) bioRxiv, doi: https://doi.org/10.1101/234666.

Lim, H.H., et al. (2006). Auditory cortical responses to electrical stimulation of the inferior colliculus: implications for an auditory midbrain implant. J. Neurophysiol. 96, 975-988.

Lim, H.H., et al. (2007). Spatially distinct functional output regions within the central nucleus of the inferior colliculus: implications for an auditory midbrain implant. J. Neurosci. 27, 8733-8743.

Markovitz, C.D., et al. (2012). Three-dimensional brain reconstruction of in vivo electrode tracks for neuroscience and neural prosthetic applications. Front. Neural Circuits 6, 39.

Markovitz, C.D., et al. (2013). Tonotopic and localized pathways from primary auditory cortex to the central nucleus of the inferior colliculus. Front. Neural Circuits 7, 77.

Markovitz, C.D., et al. (2015). Investigating a new neuromodulation treatment for brain disorders using synchronized activation of multimodal pathways. Sci. Rep. 5, 9462.

Markovitz, C.D., et al. (2015). Pairing broadband noise with cortical stimulation induces extensive suppression of ascending sensory activity. J. Neural Eng. 12, 026006.

Mehic, E., et al. (2014). Increased anatomical specificity of neuromodulation via modulated focused ultrasound. PLoS ONE 9, e86939.

Middlebrooks, J.C. (2008). Auditory cortex phase locking to amplitude-modulated cochlear implant pulse trains. J. Neurophysiol 100, 76-91.

Nakagawa, S., et al. (2006). "Development of a bone-conducted ultrasonic hearing aid for the profoundly sensorineural deaf." Transactions of Japanese Society for Medical and Biological Engineering 44.1 (2006): 184-189.

Nakagawa, Seiji, et al. "Development of a novel hearing-aid for the profoundly deaf using bone-conducted ultrasonic perception: Evaluation of transposed modulation." 2013 35th Annual International Conference of the IEEE Engineering in Medicine and Biology Society (EMBC). IEEE, 2013.

(56) References Cited

OTHER PUBLICATIONS

Nishimura, Tadashi, et al. "An examination of the effects of broadband air-conduction masker on the speech intelligibility of speech-modulated bone-conduction ultrasound." Hearing research 317 (2014): 41-49.
Nishimura, Tadashi, et al. "Ultrasonic masker clarifies ultrasonic perception in man." Hearing research 175.1-2 (2003): 171-177.
Nitsche, M.A., et al. (2008). Transcranial direct current stimulation: State of the art 2008. Brain Stimulat. 1, 206-223.
Offutt, S.J., et al. (2014). Suppression and facilitation of auditory neurons through coordinated acoustic and midbrain stimulation: investigating a deep brain stimulator for tinnitus. J. Neural Eng. 11, 066001.
Okamoto, Yosuke, et al. "Intelligibility of bone-conducted ultrasonic speech." Hearing research 208.1-2 (2005): 107-113.
Oohashi, Tsutomu, et al. "Inaudible high-frequency sounds affect brain activity: hypersonic effect." Journal of neurophysiology 83.6 (2000): 3548-3558.
Perlmutter, J.S., et al. (2006). Deep brain stimulation. Annu. Rev. Neurosci. 29, 229-257.
Ramachandran, V.S., et al. (2009). The use of visual feedback, in particular mirror visual feedback, in restoring brain function. Brain 132, 1693-1710.
Rapisarda, C., et al. (1990). Multiple representations of the body and input-output relationships in the agranular and granular cortex of the chronic awake guinea pig. Somatosens. Mot. Res. 7, 289-314.
Sato, T., et al. (2018). Ultrasonic neuromodulation causes widespread cortical activation via an indirect auditory mechanism. Neuron. Published online May 24, 2018. https://doi.org/10.1016/j.neuron. 2018.05.009.
Schofield, B.R., et al. (2011). Cholinergic cells of the pontomesencephalic tegmentum: connections with auditory structures from cochlear nucleus to cortex. Hear. Res. 279, 85-95.
Sigrist, R., et al. (2013). Augmented visual, auditory, haptic, and multimodal feedback in motor learning: a review. Psychon. Bull. Rev. 20, 21-53.
Smith, P.H., et al. (2001). Fundamental differences between the thalamocortical recipient layers of the cat auditory and visual cortices. J. Comp. Neurol 436, 508-519.
Snyder, R.L., et al. (2004). Topographic spread of inferior colliculus activation in response to acoustic and intracochlear electric stimulation. J. Assoc. Res. Otolaryngol. 5, 305-322.
Sohmer, H., et al. (2004). Further evidence for a fluid pathway during bone conduction auditory stimulation. Hear. Res. 193, 105-110.
Stein, B.E., et al. (2008). Multisensory integration: current issues from the perspective of the single neuron. Nat. Rev. Neurosci. 9, 255-266.
Straka, M.M., et al. (2013). Neural integration and enhancement from the inferior colliculus up to different layers of auditory cortex. J. Neurophysiol. 110, 1009-1020.
Straka, M.M., et al. (2014). Response features across the auditory midbrain reveal an organization consistent with a dual lemniscal pathway. J. Neurophysiol. 112, 981-998.
Straka, M.M., et al. (2015). Descending and tonotopic projection patterns from the auditory cortex to the inferior colliculus. Neuroscience 300, 325-337.
Tsirulnikov et al., "Use of Amplitude-Modulated Focused Ultrasound for diagnosis of Hearing Disorders", Ultrasound in Med & Biol, vol. 14, No. 4, pp. 277-285, Oct. 1987.
Tufail, Y., et al. (2010). Transcranial pulsed ultrasound stimulates intact brain circuits. Neuron 66, 681-694.
Tufail, Y., et al. (2011). Ultrasonic neuromodulation by brain stimulation with transcranial ultrasound. Nat. Protoc. 6, 1453-1470.
Turner, J.G., et al. (2006). Gap detection deficits in rats with tinnitus: a potential novel screening tool. Behav. Neurosci. 120, 188-195.
Tyler, W.J., et al. (2008). Remote excitation of neuronal circuits using low-intensity, low-frequency ultrasound. PLoS ONE 3, e3511.
Wallace, M.N., et al. (2000). Identification and localisation of auditory areas in guinea pig cortex. Exp. Brain Res. 132, 445-456.
Wang, Y., et al. (2008). Visuo-auditory interactions in the primary visual cortex of the behaving monkey: electrophysiological evidence. BMC Neurosci. 9, 79.
Wattiez, N., et al. (2017). Transcranial ultrasonic stimulation modulates singleneuron discharge in macaques performing an antisaccade task. Brain Stimulat. 10, 1024-1031.
Wright, C.J., et al. (2017). Unmyelinated peripheral nerves can be stimulated in vitro using pulsed ultrasound. Ultrasound Med. Biol. 43, 2269-2283.
Yamashita, Akinori, et al. "Comparison between bone-conducted ultrasound and audible sound in speech recognition." Acta Oto-Laryngologica 129.sup562 (2009): 34-39.
Ye, P.P., et al. (2016). Frequency dependence of ultrasound neurostimulation in the mouse brain. Ultrasound Med. Biol. 42, 1512-1530.
Yoo, S.-S., et al. (2011). Focused ultrasound modulates region-specific brain activity. Neuroimage 56, 1267-1275.

ULTRASONIC HEARING SYSTEM AND RELATED METHODS

CROSS REFERENCE TO RELATED APPLICATIONS

This application is a continuation application of U.S. application Ser. No. 15/581,714 filed Apr. 28, 2017 which is based on, claims priority to, and incorporates herein by reference in its entirety U.S. Provisional Application Ser. No. 62/329,804, filed Apr. 29, 2016, and entitled, "Ultrasonic Hearing System and Related Methods." The references cited in the above provisional patent application are also hereby incorporated by reference.

FIELD OF THE INVENTION

This document concerns an invention relating generally to activation of an auditory system (involved in the perception of sounds) via ultrasound stimulation of cerebrospinal fluids.

BACKGROUND

Conventional hearing aids use a microphone to detect ambient sounds and a loudspeaker to send sounds into the ear canal to help patients hear when their ears are damaged or otherwise compromised. However, sounds from the loudspeaker may reach the microphone, causing acoustic feedback issues. Also, such hearing aids direct sounds to the ear through the natural conductive pathway (that is, through the ear drum and to the middle ear bones that vibrate fluids in the cochlea). Consequently, conventional hearing aids are inadequate for certain types of hearing loss caused by physical or genetic ear damage. Moreover, conventional hearing aids or commercial hearing devices suffer from smearing of temporal and spectral information that occurs when amplifying specific frequency bands of sound features to overcome deficits in hearing or for subjects listening in noisy environments interfering with those specific sound features.

SUMMARY OF THE PRESENT DISCLOSURE

A hearing system to activate an auditory system using cerebrospinal fluids includes at least one input to capture audio signals, and at least one processor communicatively coupled with the at least one input, where the at least one processor extracts temporal and spectral features from the audio signal and creates modulated ultrasound signals in a range of 50 kHz to 4 megahertz (MHz). The system further includes at least one ultrasonic transducer which receives the modulated signal and delivers the modulated signal to at least one medium and activates the auditory system using cerebrospinal fluids.

A method to activate an auditory system using cerebrospinal fluids includes capturing audio signals with an input device, processing the audio signals with at least one processor and creating modulated ultrasound signals in a range of 50 kHz to 4 MHz. The method further includes sending the modulated ultrasound signals to at least one transducer, delivering the ultrasound modulated signals to a medium with the at least one ultrasonic transducer.

These and other embodiments, aspects, advantages, and features of the present invention will be set forth in part in the description which follows, and will become apparent to those skilled in the art by reference to the following description of the invention and referenced drawings or by practice of the invention. The accompanying drawings illustrate one or more implementations, and these implementations do not necessarily represent the full scope of the invention.

DETAILED DESCRIPTION OF THE PRESENT DISCLOSURE

Figure 1:
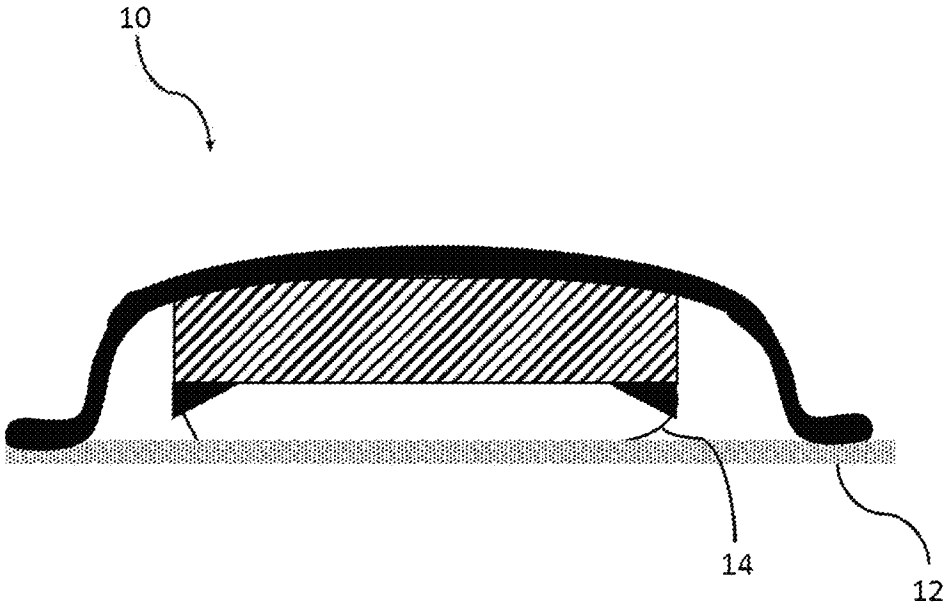
FIG. 1 is a schematic diagram of a portion of an ultrasonic hearing system according to one or more embodiments, depicting an example single wearable ultrasound transducer in contact with skin. A coupling gel, such as pads that can be periodically replaced, serve as an interface medium between the transducer and the skin. Sticky pads may be used to secure the transducer close to the skin so it is not necessary to press the transducer to the ear or head.

The following detailed description includes references to the accompanying drawings, which form a part of the detailed description. The drawings show, by way of illustration, specific embodiments in which the apparatus may be practiced. These embodiments, which are also referred to herein as "examples" or "options," are described in enough detail to enable those skilled in the art to practice the present embodiments. The embodiments may be combined, other embodiments may be utilized or structural or logical changes may be made without departing from the scope of the invention. The following detailed description is, therefore, not to be taken in a limiting sense and the scope of the invention is defined by the appended claims and their legal equivalents.

In this document, the terms "a" or "an" are used to include one or more than one, and the term "or" is used to refer to a nonexclusive "or" unless otherwise indicated. In addition, it is to be understood that the phraseology or terminology employed herein, and not otherwise defined, is for the purpose of description only and not of limitation.

Example systems and related methods are used to activate the auditory system using ultrasound as a novel hearing aid technology that addresses key challenges with conventional hearing aids. The auditory system is activated via the cochlea using ultrasound stimulation of, for example, the brain and brain/cerebrospinal fluids. Vibration of the brain and brain fluids in turn is able to lead to fluid vibrations in the cochlea through an inner ear tube/aqueduct connection that exists from the brain to the cochlea. This ultrasound-induced vibration of fluid in the cochlea then causes activation in the auditory brain to produce hearing sensation. This may be achieved by ultrasound stimulation applied at the head, or ultrasound stimulation of the body and the fluids in the body. Vibrations in different parts of the body are able to travel through the body to reach cerebrospinal fluids in the brain and spinal cord that directly connects with the fluids in the cochlea through the inner ear aqueduct. Ultrasound stimulation presented to the head of animals with and without the skull achieves similar auditory activation effects. Consequently, activation of the auditory brain with ultrasound using the specified frequency ranges listed above is not simply a "bone conductive" mechanism of activating the inner ear through the skull, as previous groups have attempted to achieve with lower ultrasound frequencies. Furthermore, the discovery shown later in FIGS. 24 to 30B demonstrate that modulated ultrasound carrier frequencies presented to cerebrospinal fluids to cochlear fluids can mimic similar auditory brain activation patterns as occurs when presenting the desired acoustic stimulus through the natural pathway of the ear drum and middle ear bones to the cochlea. The high ultrasound carrier frequencies (e.g., 100 kHz to 4 MHz) enable the signal to pass across the skull/bones to reach the cerebrospinal fluids, in which the modulated waveform matching the desired acoustic stimulus is what reaches the cochlear fluids. In other words, the high ultrasound carrier frequencies serve to "carry" the desired modulated waveform through the skull/bones to the cochlear fluids via the cerebrospinal fluids, which is a new discovery demonstrated in FIGS. 24 to 30B.

Example systems and methods can use very low energies (shown to be safe in humans for imaging applications such as fetal imaging) with ultrasound frequencies between 100 kHz to 1 MHz to be able to cause extensive auditory activation. In various implementations, power transfer may range from 1 to 500 milliwatts per square centimeter (mW/cm$^2$). The system and methods also use modulated and ramped pulse patterns to systematically control temporal and frequency activation effects in the auditory system, which are key elements for hearing in the brain. In other words, ultrasound stimulation with varying modulation patterns can be used to induce hearing in the brain. Higher ultrasonic carrier frequencies may not be practical because they require much larger energies, which can be harmful to brain tissue. Consequently, using modulated and burst patterns within a preferred range of 100 kHz to 1 MHz (up to 4 MHz could also be used with more energy-efficient technologies/algorithms) helps enable ultrasound hearing devices that use low energy and are thus feasible for daily use (i.e., are able to be powered for many hours, and do not cause brain damage). Use of ultrasound stimulation at about 50 kHz or lower may elicit ultrasound stimulation via a conductive mechanism, but such approaches exhibit significant smearing of spectral and temporal information due to the pathway through the skull/bones to the cochlea. Consequently, exemplary implementations involve vibrating brain fluids with ultrasound using a frequency range that predominantly passes through the skull to induce vibrations of brain fluids and, consequently, vibrations of fluids of the cochlea (which stimulates the auditory system). Vibration of fluids in the cochlea through this pathway may achieve a direct and systematic vibration of cochlear fluids that can mimic the vibration of cochlear fluids that occurs when sound is naturally transmitted through the ear drum to the middle ear bones that then vibrate the fluids in the cochlea.

FIGS. 1-23 illustrate various potential configurations in different implementations of the hearing system. The hearing system is used to activate an auditory system via cerebrospinal fluids (i.e., fluids surrounding the brain and spine), and may include at least one input to capture audio signals (e.g., a microphone or a receiver that obtains inputs wirelessly from another device), at least one processor communicatively coupled with the at least one input, where the at least one processor extracts temporal and spectral features from the audio signal and creates modulated ultrasound signals in a range of 50 kHz to 4 MHz. The system further includes at least one ultrasonic transducer which receives the modulated signal and delivers the modulated signal to the body via a coupling/interface medium to activate the auditory system via cerebrospinal fluids. The medium, which can be one or more of air, gel, gel sac, gel pad, gel-filled or fluid-filled tube, or solid flexible tube, provides an interface between the transducer and the body. In one example, a contained sac or pad is directly coupled to a transducer tip and is pushed up against, or stuck to, a body region.

Figure 3:
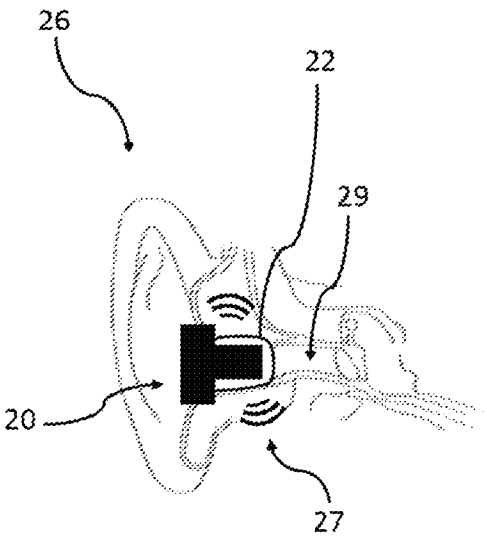
FIG. 3 is a schematic diagram depicting ultrasonic pressure waves from the transducer of FIG. 2 traveling through the skin and skull to the cerebrospinal fluids, according to one or more embodiments. It is noted that the transducers can also be positioned on other parts of the body, such as the ear canal, neck, back and stomach.
Figure 2:
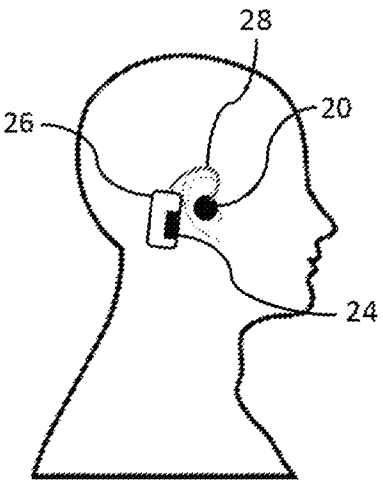
FIG. 2 is a schematic diagram of an ultrasonic hearing system according to one or more embodiments, depicting an example wearable earphone-like ultrasound hearing aid device. The interface medium (such as a coupling gel, pad, etc.) need not be a sticky pad if the transducer snugly fits in the ear canal pushed up against the inside portion of the ear canal.

FIG. 1 illustrates an example implementation with a single wearable ultrasound transducer 10. The transducer 10 can be mounted or otherwise secured to the skin 12 using an interface medium 14 (such as a coupling gel or sticky pad) that makes close contact with the skin 12 (such that a separate component for pressing the transducer against the ear or head region is preferably not necessary). FIGS. 2 and 3 illustrate a wearable earphone-like ultrasound hearing system. The transducer 20 is optionally disposed within the ear canal 29. In one or more potential implementations, the interface medium includes a coupling gel and/or a pad 22. Because it can be disposed snugly within the ear canal 29, an adhesive or bonding agent may not be necessary. FIG. 2 illustrates how the microphone 24 and battery and processor segment 26 (which may include, for example, control circuitry with a processor, as well as a source of energy such as a battery) are disposed near the transducer 20, and can be positioned behind the ear 26. The transducer 20 and processor segment 26 may be electrically/communicatively coupled via connector 28. As depicted in FIG. 3, pressure (sound) waves 27 may be delivered into the skull via medium 22.

Figure 5:
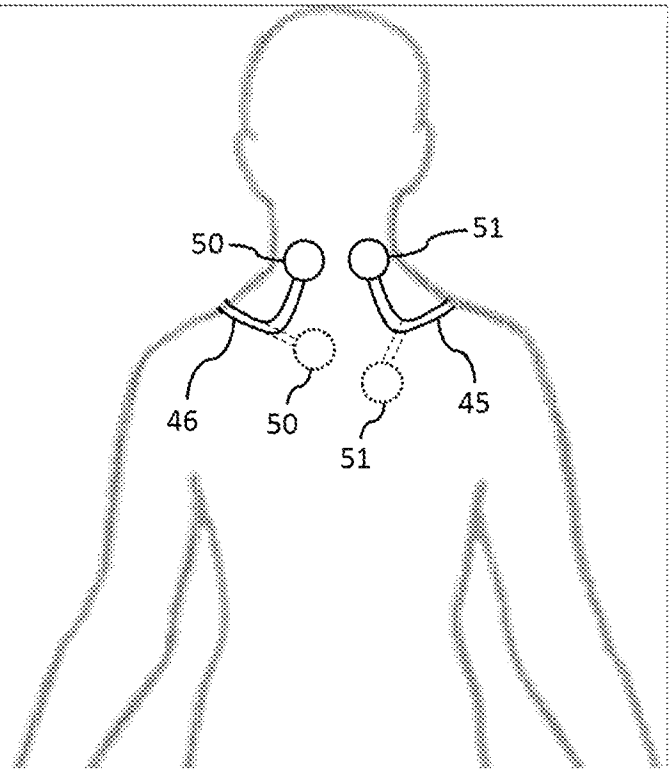
FIG. 5 is a schematic diagram of an ultrasonic hearing system according to one or more embodiments, depicting the body-worn ultrasound hearing aid device of FIG. 4 as viewed from the back of a user.
Figure 4:
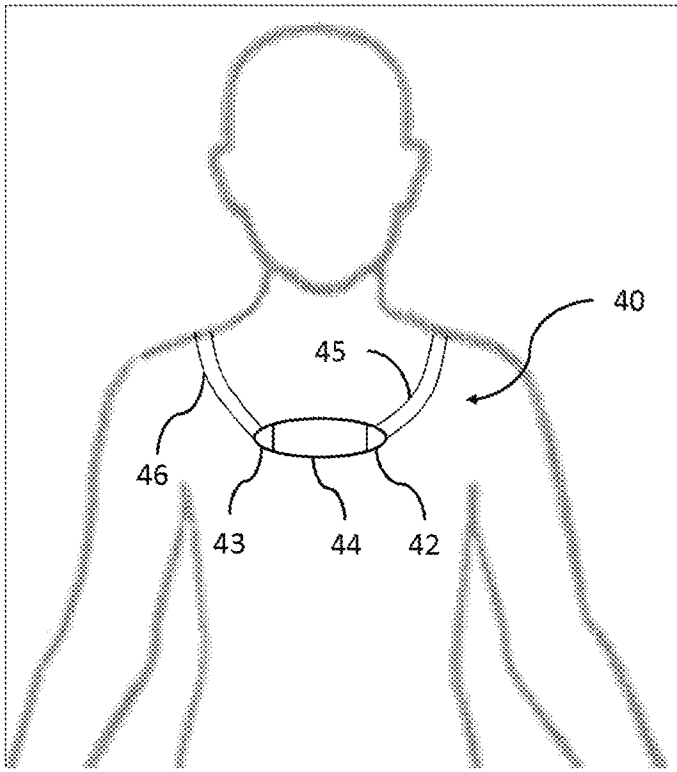
FIG. 4 is a schematic diagram of an ultrasonic hearing system according to one or more embodiments, depicting an example body-worn ultrasound hearing aid device with two ultrasound transducers, as viewed from the front of a user.

FIGS. 4 and 5 illustrate one or more embodiments of an ultrasound hearing system, showing that transducers can also be positioned on other parts of the body, such as the chest, back and/or stomach. As shown in FIG. 4, a carrier 40 may be placed around a user's neck, and for example includes arms 45, 46. At the front of the user, for example near the chest of a user, is disposed at least one microphone. In one or more embodiments, a subsystem component includes left microphones 42 and right microphones 43, with a battery and control module 44 between the left and right microphones 42, 43. Referring to FIG. 5, which shows the back of a user, a left transducer 50 and a right transducer 51 are positioned along the user's neck. As the transducers 50, 51 deliver signals to the user through the neck, the signals reach spinal and brain fluids and travel to the cochlear fluids and activate the auditory system. The transducers 50, 51 can be specified for certain frequency ranges to better attune the system for the user, as further discussed below. As illustrated in FIG. 5, arms 45, 46 may be flexible, allowing the transducers 50, 51 to be positioned and repositioned to different portions of the user's back to better suit different users. Certain portions of an individual's body may be better suited for allowing ultrasound signals to travel to the auditory system than other portions, and/or they may be more comfortable for the user.

Figure 7:
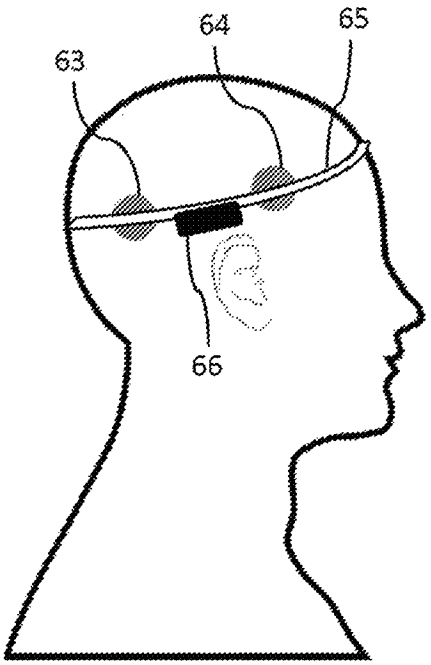
FIG. 7 is a schematic diagram of an ultrasonic hearing system according to one or more embodiments, depicting the ultrasound hearing aid headband device of FIG. 6, as viewed from the side of a user.
Figure 6:
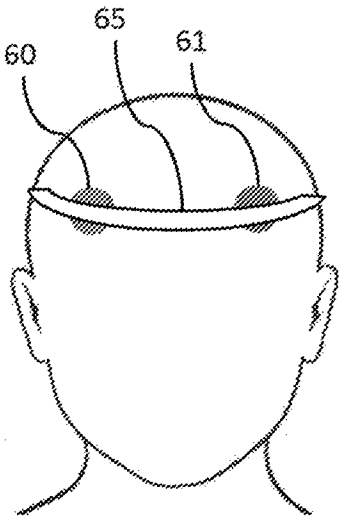
FIG. 6 is a schematic diagram of an ultrasonic hearing system according to one or more embodiments, depicting an example ultrasound hearing aid headband device with multiple transducers, as viewed from the front of a user.

FIGS. 6 and 7 illustrate one or more embodiments of an ultrasound hearing system. The system includes one or more transducers 60, 61 that can be coupled with a halo or headband 65 that is placed on the user's head (around the forehead, for example). In one or more embodiments, multiple transducers 60, 61, 63, 64 can be used with the system. The multiple transducers 60, 61, 63, 64 can be used around the perimeter of the head, positioned on the forehead, and/or positioned along the side of the head. A microphone, battery, and processor unit 66 is further coupled with the headband to provide audio input, signal processing, and power to the transducers 60, 61, 63, 64.

Figure 9:
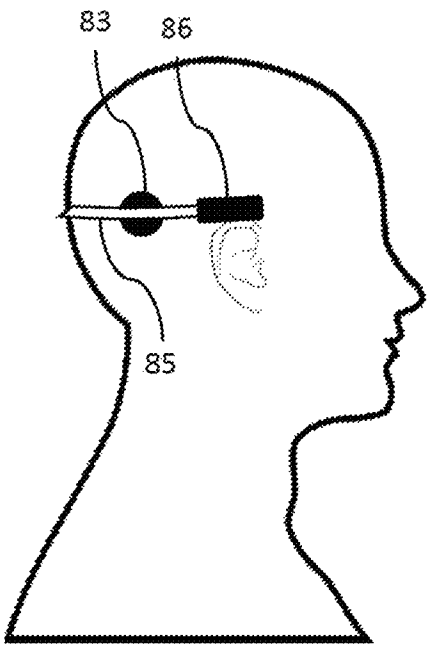
FIG. 9 is a schematic diagram of an ultrasonic hearing system according to one or more embodiments, depicting the ultrasound hearing aid head-ear frame device of FIG. 8, as viewed from the side of the user's head. It is noted that the processor and battery (depicted in FIG. 8) can also be combined with the microphone (depicted in FIG. 9).
Figure 8:
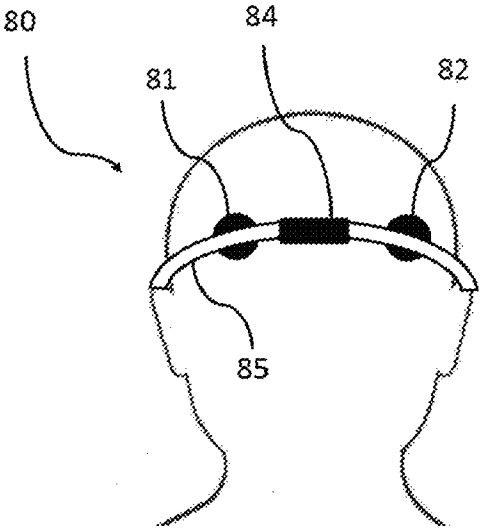
FIG. 8 is a schematic diagram of an ultrasonic hearing system according to one or more embodiments, depicting an example ultrasound hearing aid head-ear frame device (similar to glasses worn in reverse such that the lenses are positioned at the back of the head rather than in the front and over the eyes) with multiple transducers, as viewed from the back of a user's head.

Referring to FIGS. 8 and 9, a head-ear frame 80 can be used to form the ultrasound hearing system. Using the frame 80, which is positioned around the back of the user's head, multiple transducers 81, 82, 83 can be used around the perimeter of the head, positioned on the back of the head, and/or positioned along the side of the head. A microphone 86, and battery and processor unit 84, are further coupled with the frame 80 to provide audio input, signal processing, and power to the transducers 81, 82, 83. It is noted that the microphone, battery, and control circuitry (with processor) may be incorporated into one unit that is located, for example, in the back of the head (FIG. 8) or side of the head (FIG. 9).

Figure 12:
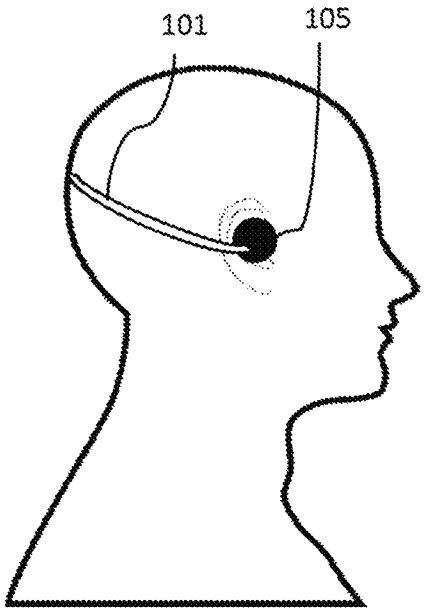
FIG. 12 is a schematic diagram of an ultrasonic hearing system according to one or more embodiments, depicting the back head ultrasound hearing aid device of FIG. 10, as viewed from the side of the user's head.
Figure 11:
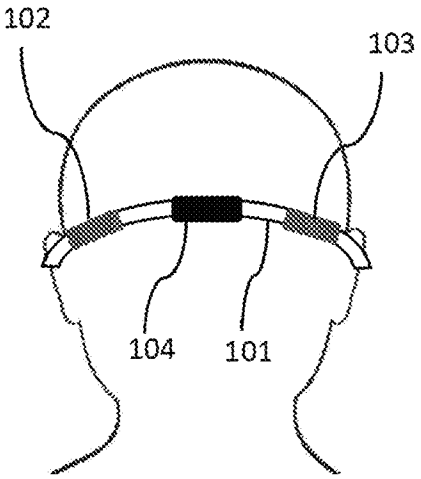
FIG. 11 is a schematic diagram of an ultrasonic hearing system according to one or more embodiments, depicting the back head ultrasound hearing aid device of FIG. 10, as viewed from the back of a user's head. It is noted that the microphone (depicted in FIG. 11) can also be placed, for example, on the sides of the head or near/in the ears (such as in FIG. 9).
Figure 10:
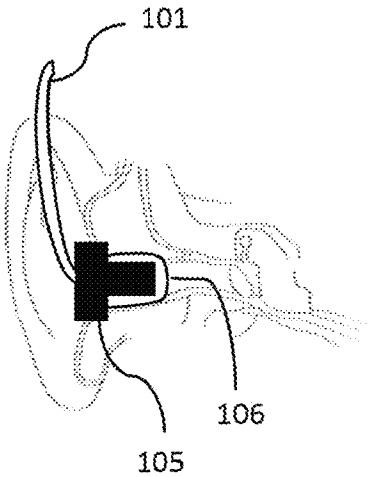
FIG. 10 is a schematic diagram of an ultrasonic hearing system according to one or more embodiments, depicting an example back head ultrasound hearing aid device with an earplug transducer.

FIGS. 10-12 illustrate one or more embodiments of the ultrasound hearing system. The system can use a headband or frame or combination thereof to which the microphone(s) 102, 103, and processor and battery unit 104 can be coupled via connector 101. The microphone(s) 102, 103 can be placed on the sides of the head, or near or in the ears. The one or more transducers 105 are in the form of an earplug (FIG. 12), and are disposed within the ear. The embodiments further optionally include a pad or gel 106, and further optionally a bonding agent (e.g., to help adhere transducer 105 to the skin). It is noted that the microphone(s) 102, 103 can also be placed on the side(s) of the head or near/in the ears.

Figure 13:
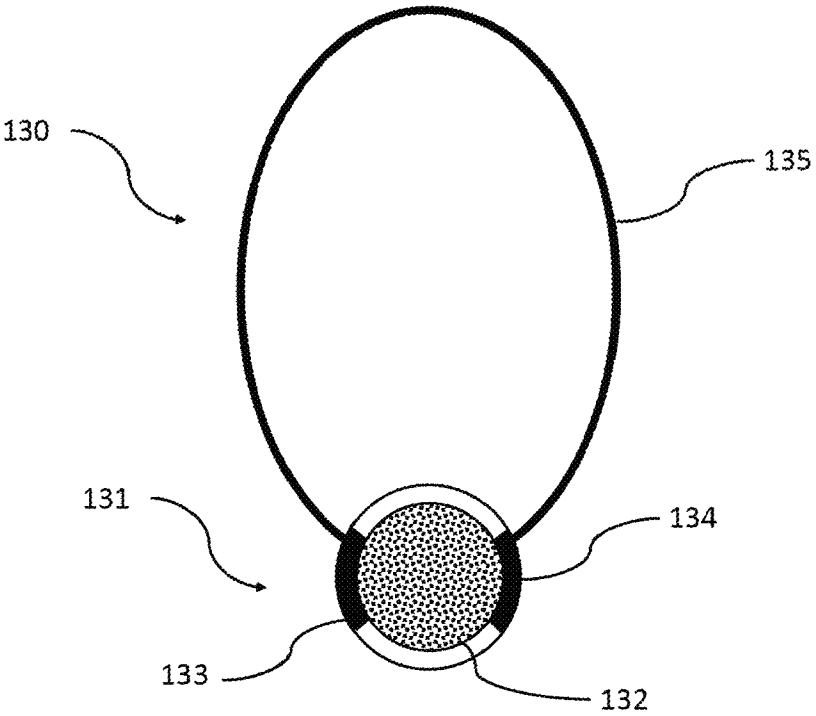
FIG. 13 is a schematic diagram of an ultrasonic hearing system according to one or more embodiments, depicting an example wearable necklace-style ultrasound hearing aid device with a single transducer. It is noted that the ultrasound transducer may be secured to the body, for example, on the chest or lower neck region where microphones are not covered by clothes.

FIG. 13 illustrates yet another embodiment, which can be used alone, or in combination with other embodiments discussed herein. The ultrasound hearing system may include a wearable "necklace" 130. The necklace may include a flexible cord or band 135 that can be placed over the head and around the neck of the user. The system, for example as shown with a round disk 131, is coupled with the cord or band 135. The disk includes microphones 133, 134, and the transducer 132 is coupled with the body, for example, the chest or lower neck region where the microphone(s) 133, 134 are not covered by a user's clothing.

Figure 16:
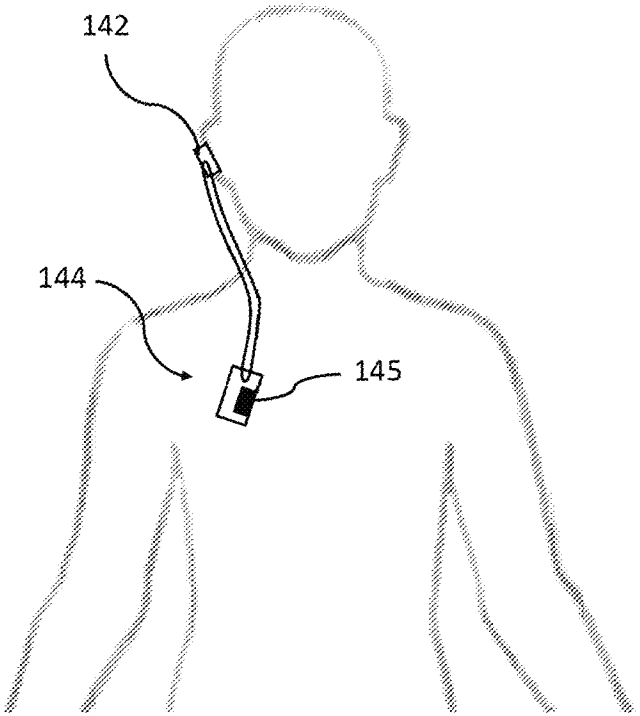
FIG. 16 is a schematic diagram of an ultrasonic hearing system according to one or more embodiments, depicting the example wearable hearing aid device of FIG. 14, as viewed from the front of a user.
Figure 15:
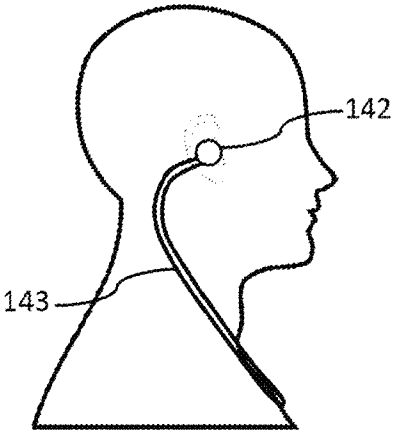
FIG. 15 is a schematic diagram of an ultrasonic hearing system according to one or more embodiments, depicting the example wearable hearing aid device of FIG. 14, as viewed from the side of the user's head.
Figure 14:
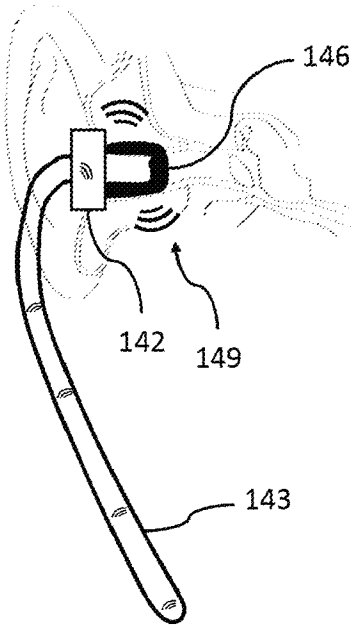
FIG. 14 is a schematic diagram of an ultrasonic hearing system according to one or more embodiments, depicting an example remote wearable earphone-like ultrasound hearing aid device.

FIGS. 14-16 illustrate one or more embodiments of the ultrasound hearing system, which includes a transducer 142, controlling circuit/processor and battery unit 144. The unit 144 may be placed, for example, into a pocket, without necessarily touching the skin, as ultrasound signals 149 will propagate from the device (with an ultrasound transducer 142 built into the device) through a track 143 to ear canal (via interface medium/coupler 146). A microphone 145 on the device should be exposed without too much blocking by clothes. The transducer 142 can also be placed on the ear similar to a typical hearing aid device. Use of the track 143 allows for couplers 146 in different locations on the head or body as needed, in which the device/transducer 142 is placed on the ear or other part of the head/body (with only the couplers 146 touching the head/body). The track 143 is used to send signals to the transducer 142. The track may be a flexible track, such as a tube, filled with a coupling medium. The signals may be sent through the track to the coupler 146, such as an earplug filled with an interface medium. The track can also be a solid flexible material, and is able to serve in transmission of the ultrasound signals.

Figure 18:
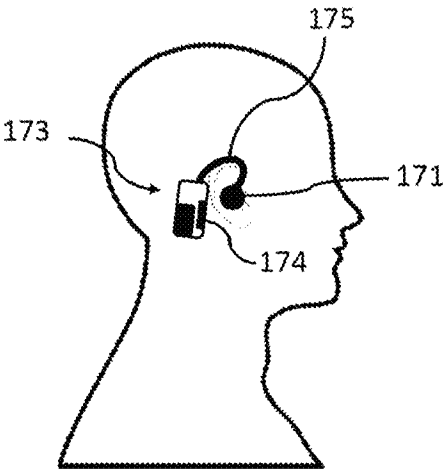
FIG. 18 is a schematic diagram of an ultrasonic hearing system according to one or more embodiments, depicting the example hearing aid device of FIG. 17, as viewed from the side of the user's head. An example ultrasound hearing device may include a microphone, transducer, control circuitry, and battery.
Figure 17:
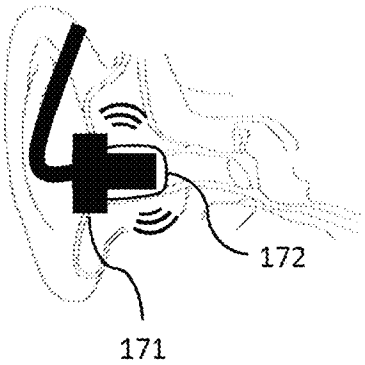
FIG. 17 is a schematic diagram of an ultrasonic hearing system according to one or more embodiments, depicting an example wearable earphone-like ultrasound hearing aid device with an interface/coupling medium referred to as a "coupler." An "earplug" may be filled with the coupler.

FIGS. 17 and 18 illustrate one or more embodiments for the system which includes a transducer 171, control circuit/processor and battery unit 173, microphone 174, and a coupler 172. The coupler 172 can be an earplug, which is disposed within the ear, as shown in FIG. 17. The transducer 171 may be coupled to the control circuit/processor and battery unit 173 via track 175. The earplug can further be filled with a coupling medium. The other components can be disposed behind an ear, as shown in FIG. 18. The transducer sends the modulated ultrasonic signals to the coupler through the track 175, and the signals can pass through the skull and reach the cerebrospinal fluid.

Figure 19:
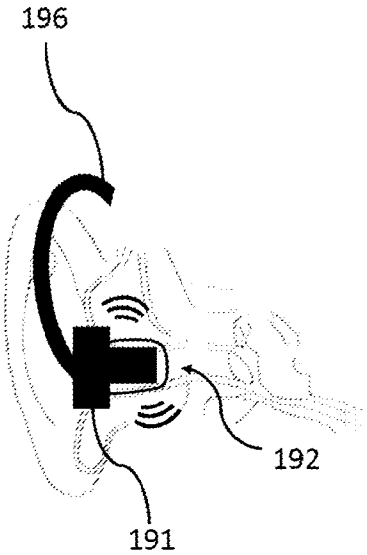
FIG. 19 is a schematic diagram of an ultrasonic hearing system according to one or more embodiments, depicting an example back head ultrasound hearing aid device with earplug transducer and coupler. An earplug may be filled with the "coupler" coupling medium.
Figure 20:
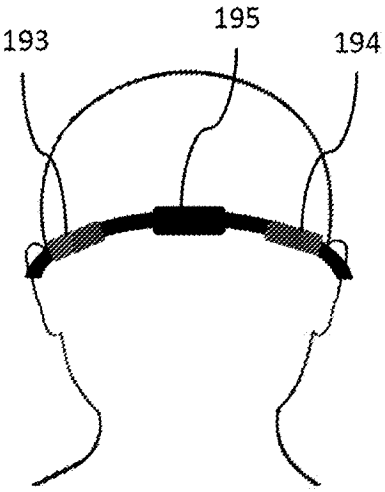
FIG. 20 is a schematic diagram of an ultrasonic hearing system according to one or more embodiments, depicting the example hearing aid device of FIG. 19, as viewed from the back of the user's head. An example ultrasound hearing device may include one or more microphones, one or more transducers, control circuitry, and a battery. A flexible track may be filled with coupling medium.
Figure 21:
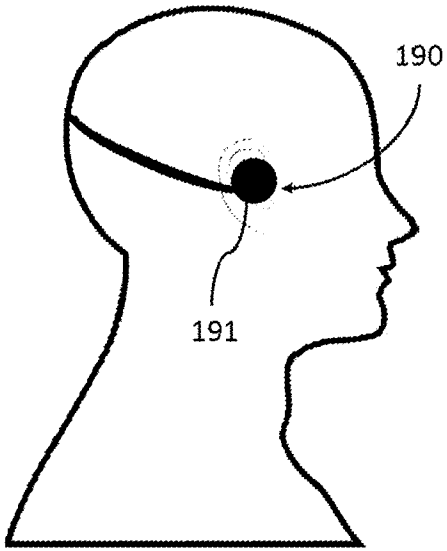
FIG. 21 is a schematic diagram of an ultrasonic hearing system according to one or more embodiments, depicting the example hearing aid device of FIG. 19, as viewed from the side of the user's head. It is noted that the microphone (shown in FIG. 20) could also be placed on the sides of the head (FIG. 21) and/or near/in the ears (FIG. 19).

Referring to FIGS. 19-21, a back head ultrasound hearing system with earplug, transducer, and coupler are shown. The system 190 includes a transducer 191, processor or controlling circuit and battery unit 195, microphones 193, 194, and a coupler 192. The coupler 192 can be an earplug, which is disposed within the ear, as shown in FIG. 19. The earplug can be filled with a coupling/interface medium. The transducer 191 optionally forms part of the earplug and is disposed near/within the ear. The transducer 191 sends the modulated ultrasonic signals to the coupler 192 through the track 196, and the signals pass through the skull and reach the cerebrospinal fluid. The other components can be disposed on the headband at the back of the head, as shown in FIG. 20.

Figure 23:
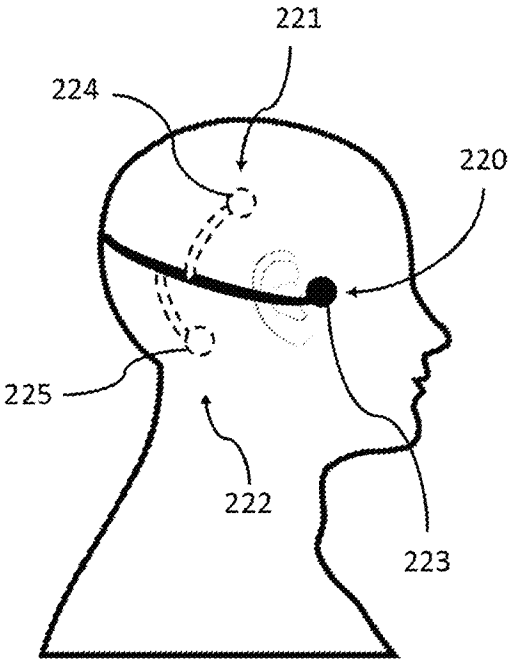
FIG. 23 is a schematic diagram of an ultrasonic hearing system according to one or more embodiments, depicting the example hearing aid device of FIG. 22, as viewed from the side of the user's head. It is noted that the coupler can be placed on the asterion, pterion, bregma, and lambda, vibrating the cerebrospinal fluid through these ultrasound windows. The zygomatic arch, which is one of the thinnest parts of the skull, would be a window that allows for particularly good transmission of ultrasound signals through the skull to the brain and cerebrospinal fluid.
Figure 22:
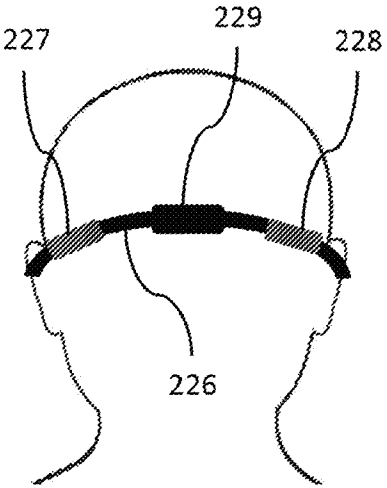
FIG. 22 is a schematic diagram of an ultrasonic hearing system according to one or more embodiments, depicting an example hearing aid device with "coupler/track" on asterion, pterion, bregma, and lambda as potential ultrasound windows (i.e., locations where ultrasound signals may be delivered to the body). It is noted that the microphone could also be placed on the sides of the head and/or near/in the ears.

FIGS. 22 and 23 illustrate placement of one or more couplers 220, 221, 222 for the system. The couplers are connected with one or more transducers 223, 224, 225 of the system, as discussed above. The couplers 220, 221, 222 may be coupled directly with the transducers 220, 221, 222 (as shown) or indirectly with the transducers. For example, a flexible track 226 filled with a coupling medium may be connected between the transducer and the coupler. The track 226 can serve as a mounting structure, to mount on a user, such as around the head. The structure 226 can also be used to position the couplers 220, 221, 222 and/or transducers 223, 224, 225 along certain parts of the head, such as, but not limited to one or more of the asterion, pterion, bregma, lambda, or zygomatic arch (which is a thinner or more penetrable skull region for ultrasound waves), which have effective transmission through the skull to brain fluid. As discussed above, the system includes microphones 227, 228, and a controlling circuit/processor and battery unit 229.

As mentioned above, the ultrasound hearing system is used to activate an auditory system using cerebrospinal fluids, where the system includes at least one input (e.g., a sound sensor such as one or more microphones or a receiver obtaining input from another device or a recorded input on the processor itself) to capture audio signals (such as ambient sounds around the user and/or recorded sounds), at least one processor communicatively coupled with the at least one input, where the at least one processor extracts temporal and spectral features from the audio signal and creates modulated ultrasound signals in a range of 50 kHz to 4 MHz. In one or more embodiments, the modulated range includes 20 Hertz (Hz) to 20 kHz and it can be any complex waveform within this range that is used to modulate very high carrier ultrasonic frequency or frequencies for different head/ear/body regions. In one or more embodiments, 20 Hz to 20 kHz modulation frequencies and temporal fluctuations are used to modulate those 50 kHz to 4 MHz carrier ultrasonic frequencies. For example, the recorded sound (being recorded in real-time or previously-recorded and received) can be bandpass filtered from 50 Hz to 12 kHz (or the full audible range of 20 Hz to 20 kHz, if needed) to obtain a filtered signal. The filtered signal/waveform is used to modulate the ultrasonic carrier frequency (which can be 1 MHz or 100 kHz or multiple of these high carrier frequencies). In various implementations, different carrier frequencies can be used for different locations on the body, e.g., 1 MHz carrier signals may be used when ultrasound is to be delivered to areas of the skull, and 100 kHz for chest areas. Both locations can be stimulated at the same time in which both carriers are modulated with 50 Hz-12 kHz (or 20 Hz to 20 kHz) modulation.

The system further includes at least one ultrasonic transducer which receives the modulated signal and delivers the modulated signal to at least one medium and activates the auditory system via cerebrospinal fluids. The transducer can be coupled with, for example, one or more of an ear, neck, chest, back, and/or stomach of a body. Further options for the hearing system are as follows. For instance, in one or more options, at least one transducer is an array of transducers, or a left and right transducer, and optionally each transducer may be used to receive the modulated signal within a predefined frequency range. The system further includes an interface medium, such as an air, or gel, or a coupler. The coupler can include an elongated tube that extends from a first end to a second end, with the first end coupled with the transducer and the second end for coupling with a portion of a body, such as, but not limited to, an ear.

Figure 24:
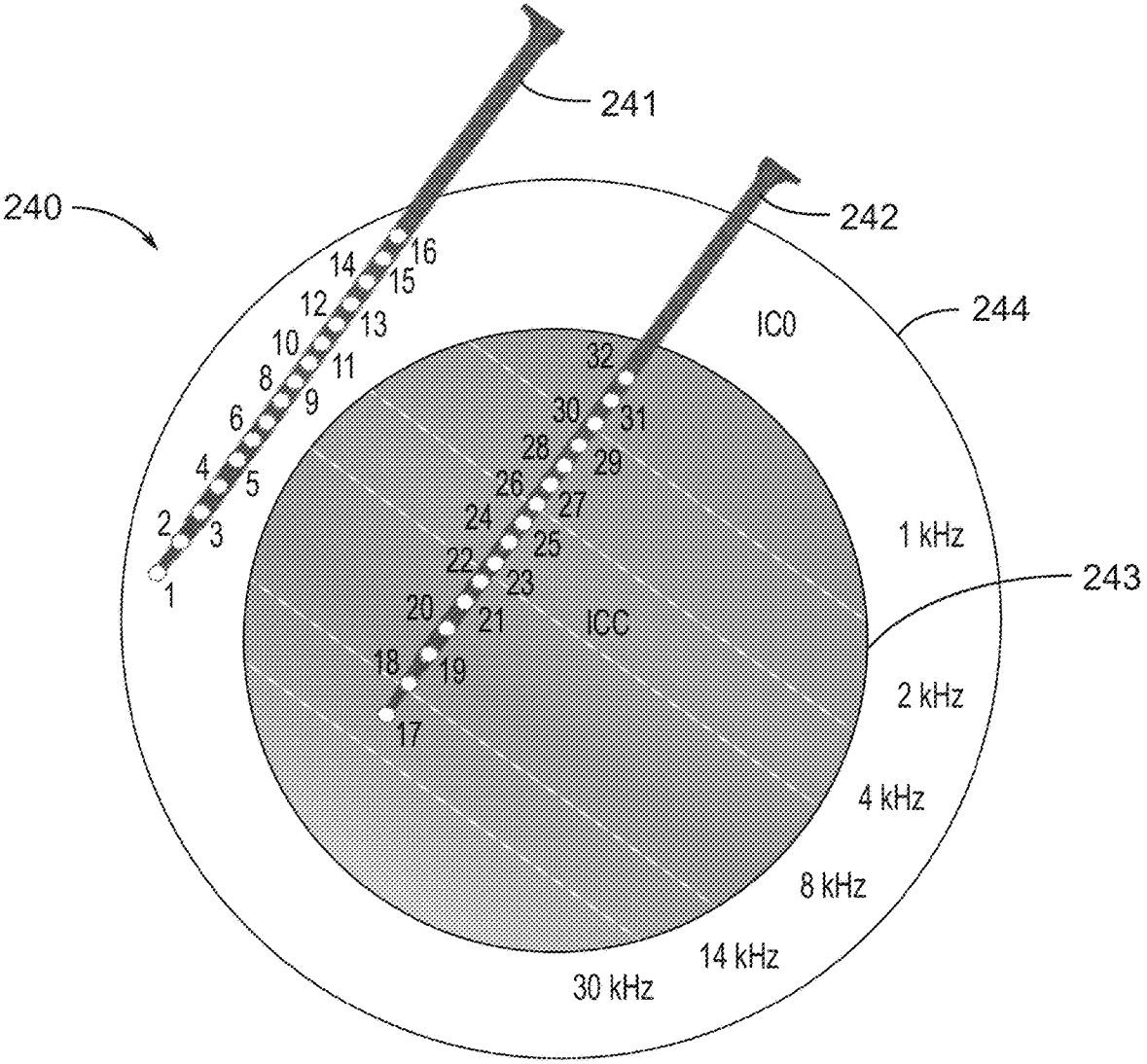
FIG. 24 illustrates two electrode array shanks with 32 total electrode channels (16 channels along each shank), and depicts a basic tonotopy of the inferior colliculus (IC), particularly its central nucleus ("ICC"), with less tonotopy but broad activation in its outer region ("ICO").

FIGS. 24-30B illustrate how the systems and related methods activate the cochlea and auditory nerve up to the auditory brain. FIG. 24 shows the basic tonotopy in a guinea pig 240 (i.e., different neurons are sensitive to a best pure tone frequency and organized in an orderly pattern) of the inferior colliculus (IC), which is the main auditory center of the midbrain before going up to the thalamus and cortex for hearing perception. The central nucleus of the inferior colliculus (ICC) 243 has bands (as suggested by the gradient) that respond to different auditory frequencies. For example, a region in the top right will increase activity when a 1 kHz sound is played while a region in the bottom left will increase activity in response to a 30 kHz stimulus. The outer region of the inferior colliculus (ICO) 244 responds generally well to all auditory frequencies. Electrode shanks 241 and 242, with 16 channels each, are positioned such that the 32 total channels correspond with different frequencies in the auditory system.

Figure 25A:
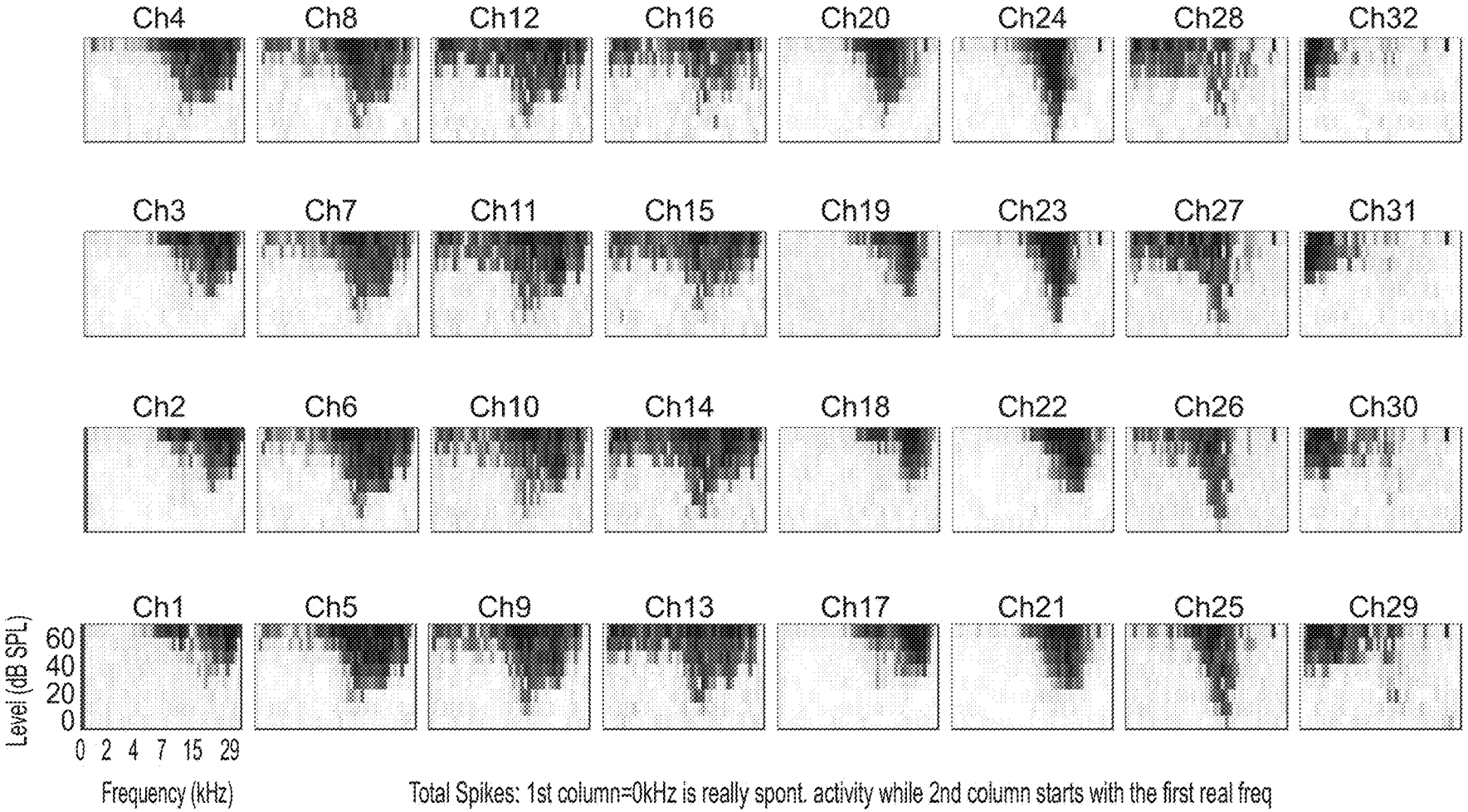
FIG. 25A shows a set of frequency response maps for the channels depicted in FIG. 14.
Figure 25B:
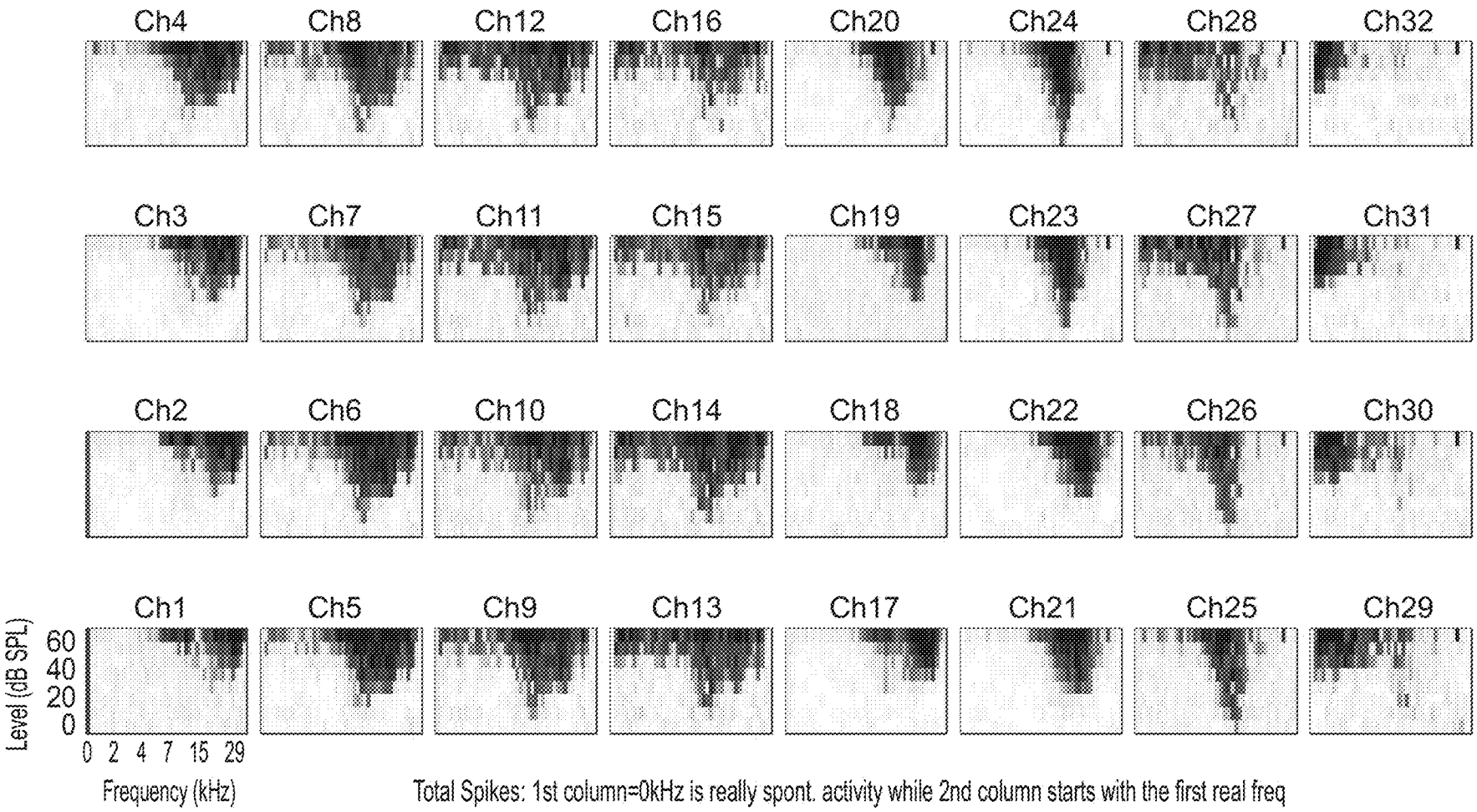
FIG. 25B shows the frequency response maps of FIG. 25A, with the response maps labeled with channel numbers with which they correspond.

FIG. 25A provides a frequency response map associated with the two electrode array shanks (16 electrode channels along each shank, providing 32 total maps) depicted in the ICO and ICC. The frequency response map has stimulus frequency along the x-axis and the level of the stimulus along the y-axis. Channels 1-16 respond to most frequencies while, as one progresses from channel 17 to channel 32 on the electrode shank in the ICC, the sites respond to higher frequencies on site 17 and move to lower frequencies towards site 32. The frequency bands are color coded with their representative frequencies shown around the ICC. The darker color in the frequency response maps indicate stronger spiking/neural activity. FIG. 25B provides the response map of FIG. 25A but with channels more clearly labeled. The frequency response map is useful in customizing the hearing system based on a hearing subject's frequency needs, in which for humans these types of frequency response maps could be obtained by using noninvasive electroencephalography (EEG) and psychophysics to determine hearing thresholds and sensitivity to different frequencies and intensities.

Figure 26:
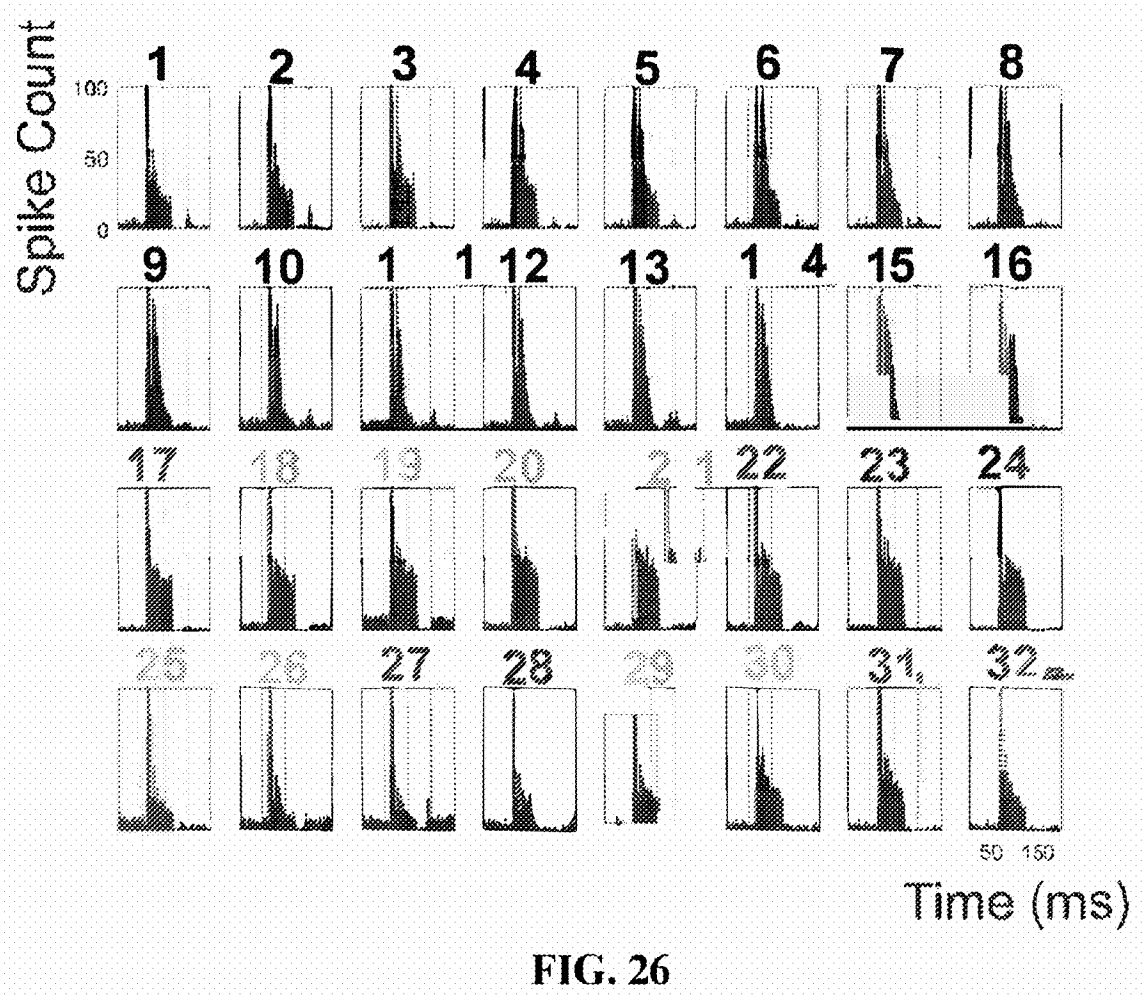
FIG. 26 illustrates the two electrode array shanks of FIG. 24 with responses on 32 total electrode channels to 70 decibel sound pressure level (dB SPL) broadband noise presented for 50 milliseconds (ms) with a stimulus start time at 60 ms. Post stimulus time histograms (PSTHs), in which time is on the x-axis and spike count is on the y-axis, are presented.

In FIG. 26, the response of each electrode in the electrode array shanks in the IC (FIG. 24) to 70 dB SPL broadband noise presented for 50 ms, with a stimulus onset at 60 ms, is provided. Post stimulus time histograms (PSTHs), with time on the x-axis and spike count on the y-axis, are presented. When the number of spikes for a given bin of the histogram increases, this indicates an increase in neuronal activity of the auditory system in response to a stimulus. Activity increases on all sites when the auditory stimulus is played (starting at 60 ms), as all of these areas respond to some frequency in the broadband signal. Above each PSTH is the channel it represents. Channels 1-16 are in the ICO and respond to a majority of the auditory frequencies. Channels 17-32 are displayed according to the frequency band shading to which the best response is received.

Figure 27:
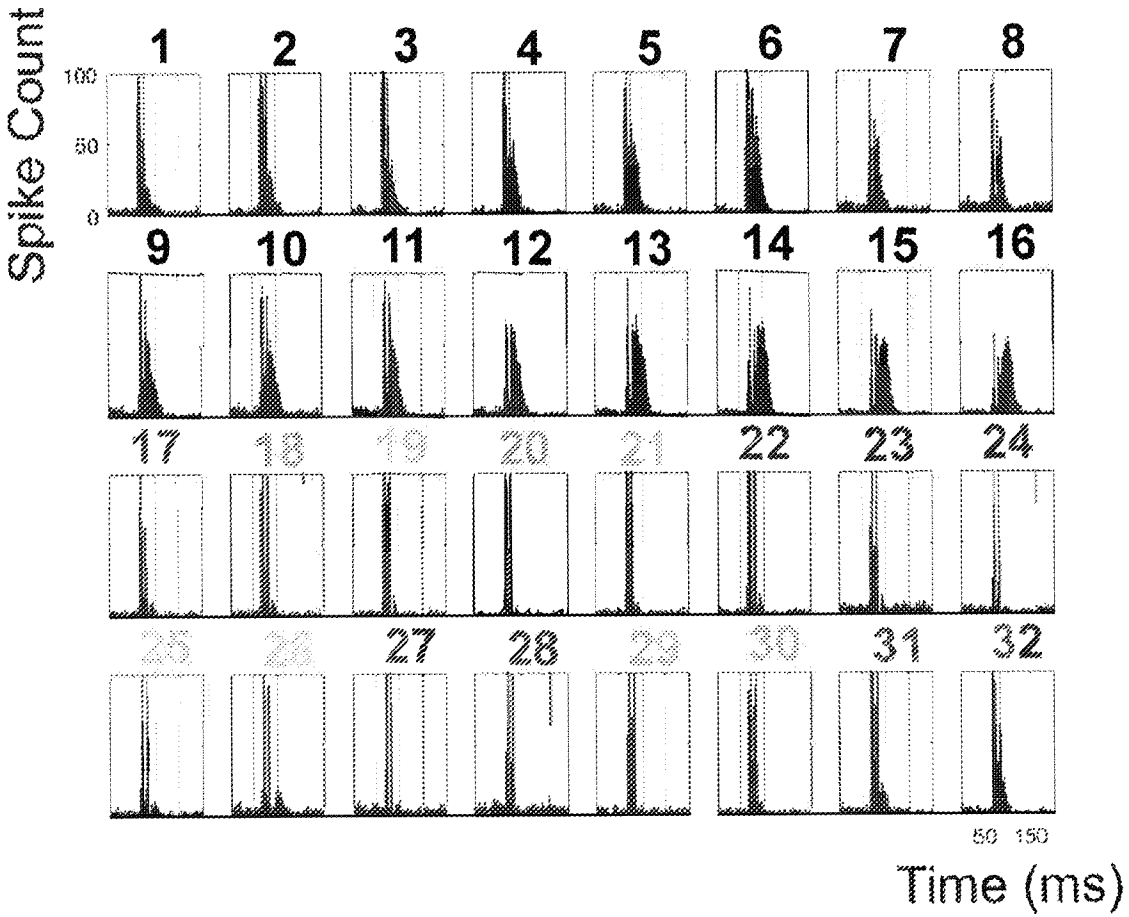
FIG. 27 provides PSTHs in response to a 2 megapascal (MPa) square wave ultrasonic signal corresponding to the 32 channels depicted in FIG. 24.

Referring to FIG. 27, the PSTHs are in response to a square wave ultrasound signal (in this case a 1 MHz ultrasonic carrier frequency is used with a 10 ms pulse duration, although other ultrasonic carrier frequencies and pulse durations can be used effectively). The ICO sites that respond to most frequencies show increased activity, but less so for the ICC sites. This is to be expected as this signal does not contain any particular frequency band, but may be better represented as an auditory click with a broad range of frequencies. The ultrasound was presented on the skull directly over the contralateral visual cortex (similar types of results can be observed by placing the ultrasound transducer in different locations on the head, neck or body, and also directly on the dura and brain with the skull removed). The transducer remains in this location for all subsequent figures. These results demonstrate a key finding that ultrasound waves can reach the brain by going through the skull to vibrate the fluids in the brain and the fluids in the cochlea, which in turn can activate the auditory system and mimic the types of activation that are caused by natural sound stimulation through the ear drum to middle ear ossicles to the cochlea. FIGS. 26 and 27 show similar types of activation for a broadband sound stimulus versus a broadband ultrasound stimulus. Similar types of activation between a sound stimulus versus a modulated ultrasound stimulus also occur for individual frequency components, as further discussed below. Individual frequency components are the fundamental components that make up any sound stimulus, based on Fourier Theory, and thus the findings below indicate that any desired sound stimulus can be recreated in the auditory system by using modulated ultrasound stimulation of the cerebrospinal fluids to the cochlea.

Figure 28A:
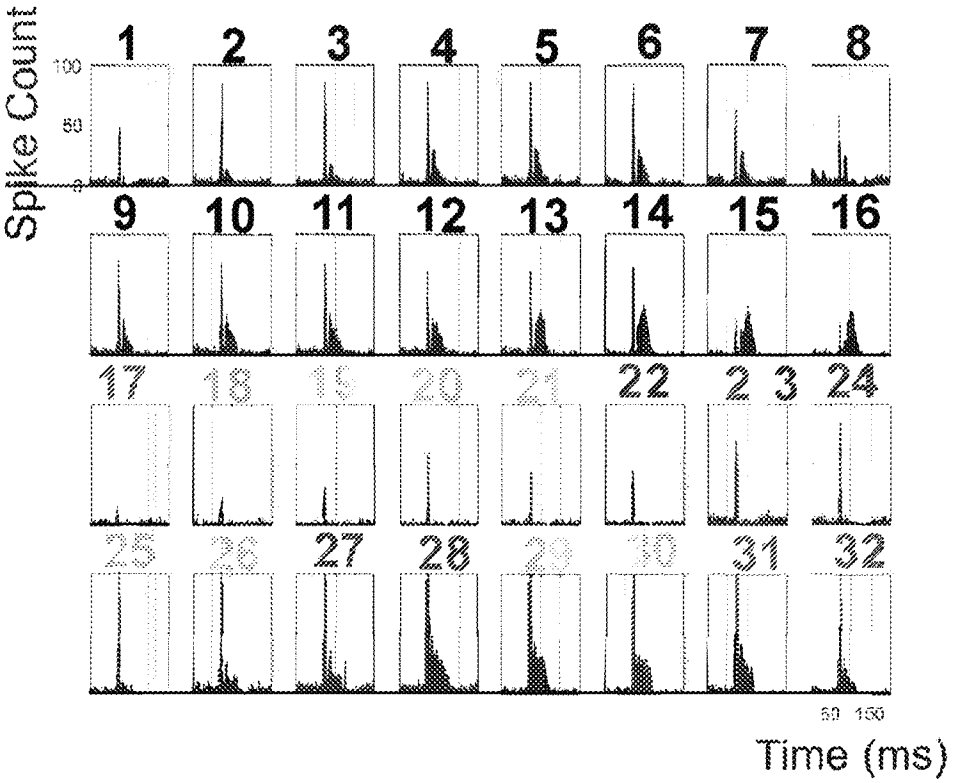
FIG. 28A shows PSTHs in response to a 70 dBSPL pure tone, 1 kHz auditory stimulus presented for 50 ms corresponding to the 32 channels depicted in FIG. 24.
Figure 28B:
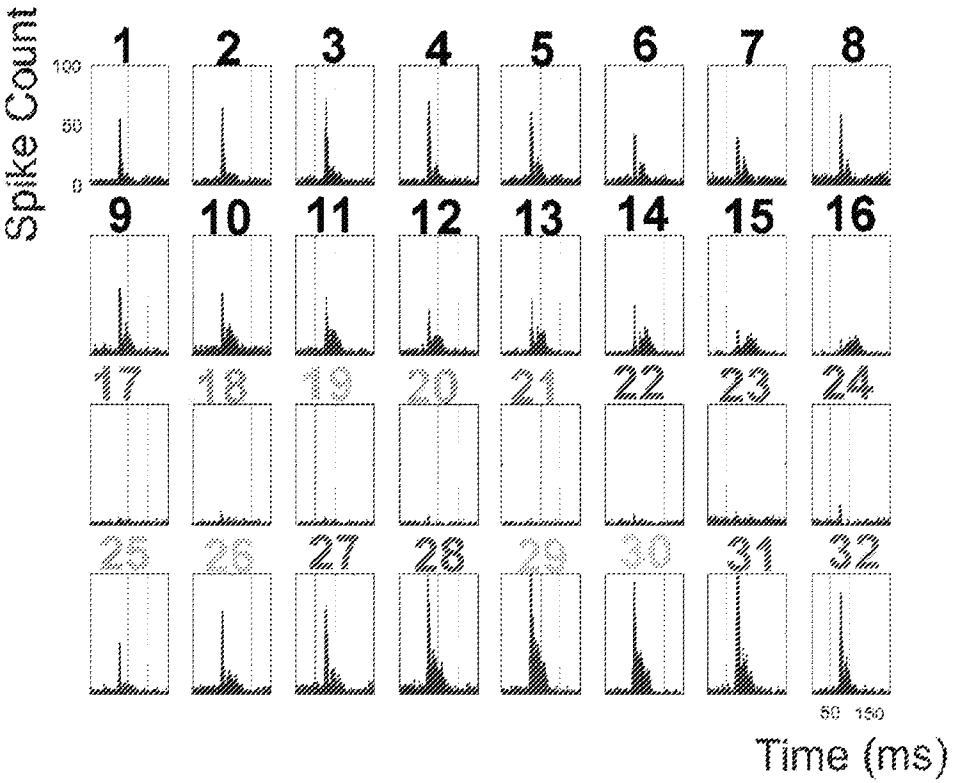
FIG. 28B shows PSTHs in response to a 2 MPa 1 kHz modulated ultrasound stimulus (with a 1 MHz ultrasonic frequency carrier) corresponding to the 32 channels depicted in FIG. 24.

FIG. 28A shows a pure tone signal received by a mammal with normal hearing ability. FIG. 28B shows use of the device described herein. In FIGS. 28A and 28B, the two PSTHs shown are in response to a 1 kHz auditory stimulus and a 1 kHz modulated ultrasound stimulus (in this case, a 1 MHz ultrasonic carrier frequency is used, but different carrier frequencies can also be used effectively). The two PSTHs look similar, suggesting that the modulated ultrasound signal presented to the head activates similar neurons as occurs to an auditory signal of equal frequency presented through the natural pathway of the ear canal.

Figure 29A:
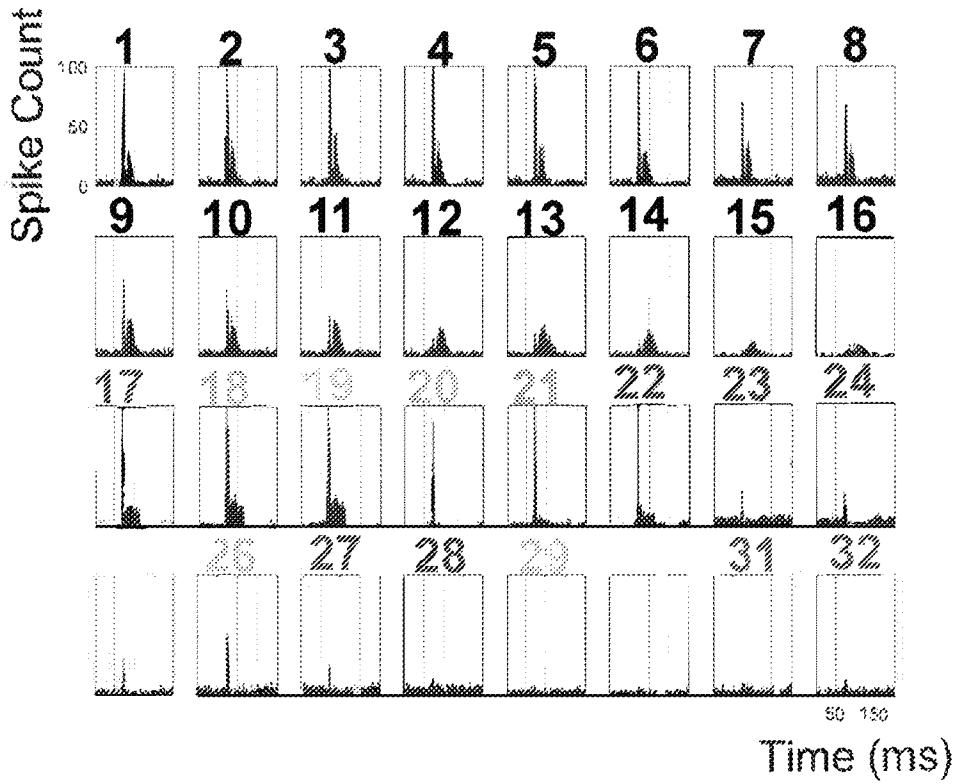
FIG. 29A shows PSTHs in response to a 50 dBSPL pure tone, 14 kHz auditory stimulus for presented for 50 ms corresponding to the 32 channels depicted in FIG. 24.
Figure 29B:
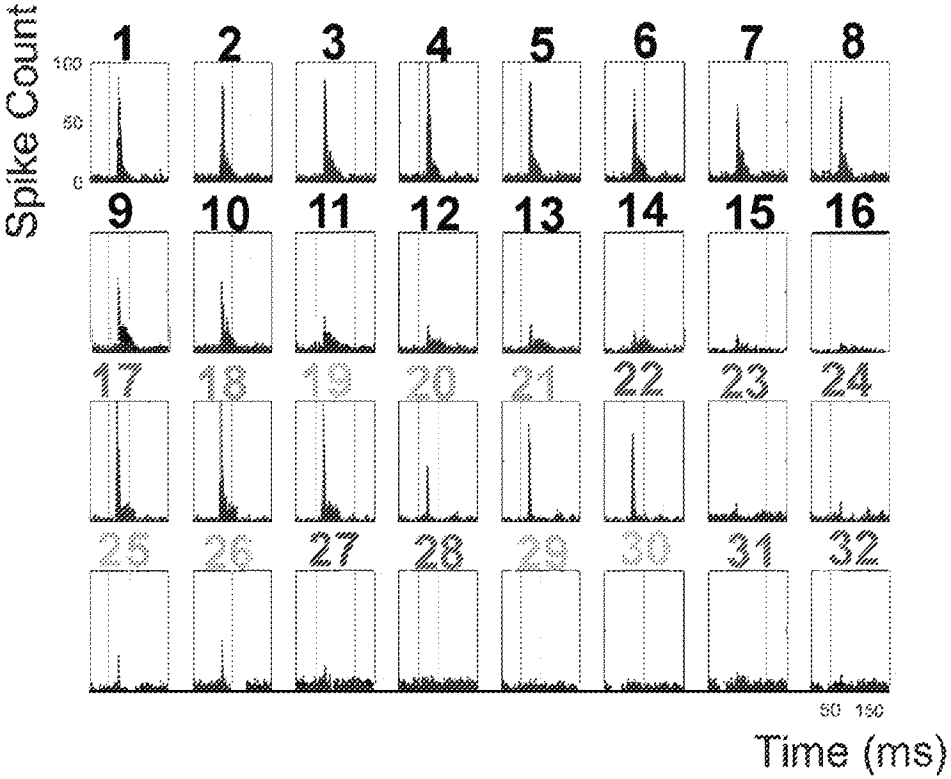
FIG. 29B shows PSTHs in response to a 2 MPa 14 kHz modulated ultrasound signal (with a 1 MHz ultrasonic carrier frequency) corresponding to the 32 channels depicted in FIG. 24.

FIGS. 29A and 29B are similar to FIGS. 28A and 28B, but show specificity for a higher frequency, in this case 14 kHz. Equivalent amplitude of sound activation here is less than the 1 kHz example. This suggests that some processing may be required in order to properly adjust gains for different frequency components to reconstruct sounds for the auditory system, which is the conception of the multi-band gain adjustments discussed below (with reference to FIGS. 33 and 34).

The data presented above demonstrate that modulated ultrasound stimulation can achieve a coding resolution of individual frequency sound components (i.e., similar to individual pure tone frequency stimuli). Consequently, based on Fourier Theory, modulated ultrasound stimulation can recreate activation of any desired sound stimulus in the auditory system by going through the skull or body to vibrate the cerebrospinal fluids to then vibrate the fluids in the cochlea.

Figure 30A:
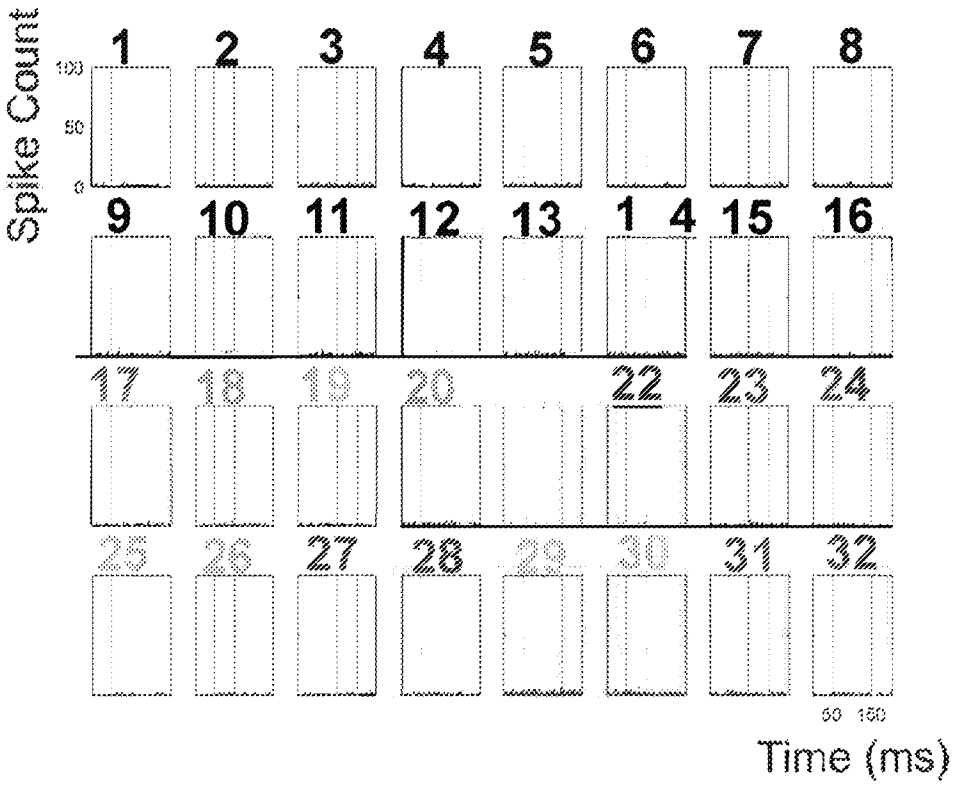
FIG. 30A shows PSTHs in response to broadband noise at 70 dBSPL, with a cut auditory nerve, corresponding to the 32 channels depicted in FIG. 24.
Figure 30B:
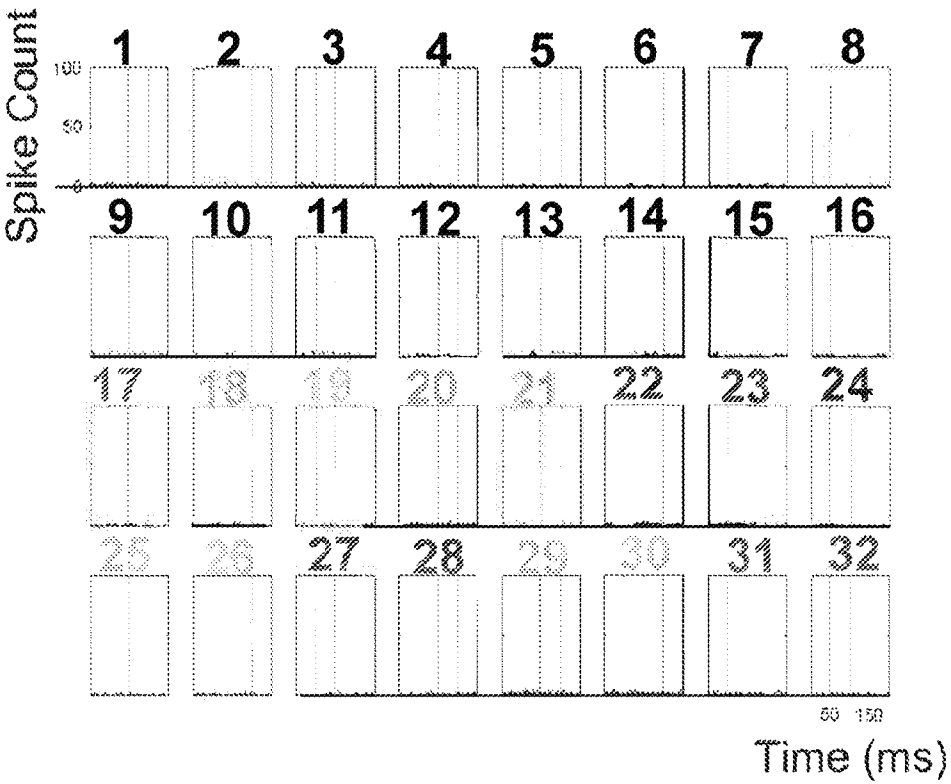
FIG. 30B shows PSTHs in response to a 2 MPa 14 kHz ultrasound signal (with a 1 MHz ultrasonic frequency carrier), with a cut auditory nerve, corresponding to the 32 channels depicted in FIG. 24. As illustrated by FIGS. 30A and 30B, the auditory system (i.e., ICC/ICO) stops responding to auditory and ultrasonic signals, providing evidence that the ultrasonic stimulus is causing an auditory effect in the brain.

FIGS. 30A and 30B further demonstrate that the system and methods discussed herein can activate the auditory system. Referring to FIGS. 30A and 30B, when the auditory nerve is cut, the IC stops responding to auditory and ultrasound signals, confirming that ultrasound stimulation is activating the auditory system through the cochlea and auditory nerve up to the auditory brain.

FIGS. 31-34 illustrate related methods of ultrasonic hearing system. In one or more embodiments, a method to activate an auditory system using cerebrospinal fluids includes receiving a sound signal to be perceived by a user, such as by capturing audio signals with an input device or a wireless receiver from another device. The sound/audio signal may then be processed with at least one processor and a modulated ultrasound signals generated in a range of 50 kHz to 4 MHz. The method further includes sending the modulated ultrasound signals to at least one transducer, and delivering the ultrasound modulated signals to a medium with the at least one ultrasonic transducer.

Several options for the methods are as follows. For instance, in one or more embodiments, processing the audio signals and creating ultrasound modulated signals with carrier signals occurs in a range of 100 kHz-1 MHz. In a further option, the method further includes filtering the audio signals with at least one bandpass filter and creating at least one filtered signal, and further optionally each filtered signal is amplified and compressed to compensate for frequency-specific deficits, and/or further comprising reconstructing each filtered signal to a time-domain, and optionally using the time-domain signal to modulate the ultrasound carrier signal that is between 100 kHz to 1 MHz or 50 kHz to 4 MHz. In one or more embodiments, the ultrasound carrier is one frequency or multiple frequencies between 100 kHz-1 MHz or 50 kHz to 4 MHz. In one or more embodiments, sending modulated signals to at least one transducer includes sending modulated ultrasound signals to an array of ultrasonic transducers each having a pre-determined frequency range.

In one or more embodiments, the modulated range includes 20 Hz to 20 kHz and it can be any complex waveform within this range that is used to modulate very high carrier ultrasonic frequency or frequencies for different head/ear/body regions. In one or more embodiments, 20 Hz to 20 kHz modulation frequencies and temporal fluctuations are used to modulate the 50 kHz to 4 MHz (or 100 kHz to 4 MHz, 100 kHz to 1 MHz, etc.) carrier ultrasonic frequencies. For example, the recorded/desired sound signal can be bandpass filtered from 50 Hz to 12 kHz (or the full audible range of 20 Hz to 20 kHz, if desired) to obtain the filtered signal. The filtered waveform may be used to modulate the ultrasonic carrier frequency (which can be 1 MHz or 100 kHz or multiple of these high carrier frequencies) or a continuous range of ultrasonic carrier frequencies (e.g., all frequencies between 100 kHz to 200 kHz or 500 kHz to 1 MHz, etc.). Different carrier frequencies can be used for different locations on the body, e.g., 1 MHz for skull area and 100 kHz for chest area. Both locations can be stimulated at the same time in which both carriers are modulated with 50 Hz to 12 kHz modulation.

Figure 31:
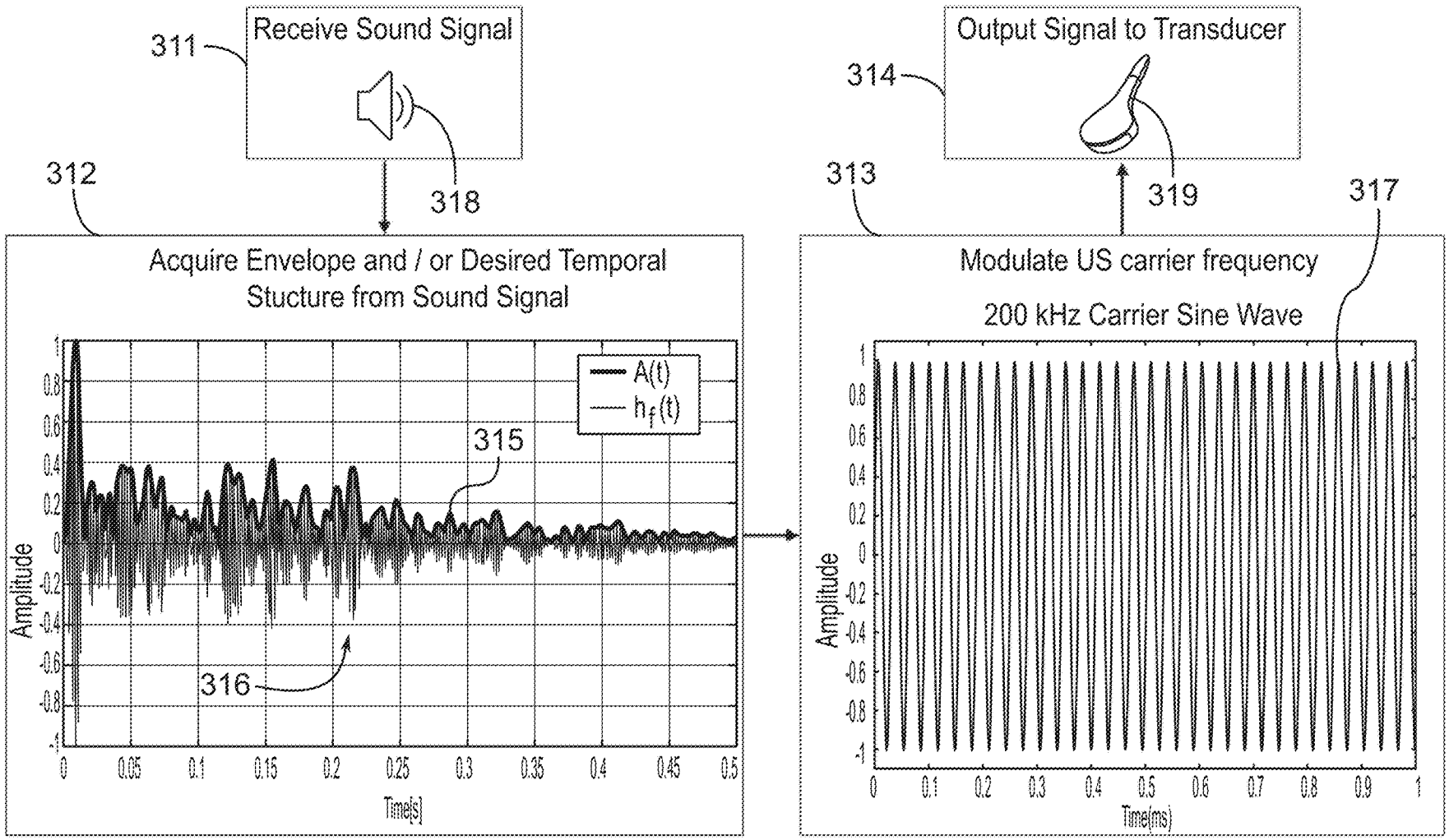
FIG. 31 is a flow chart of an example system and related method according to one or more embodiments, illustrating envelope/temporal feature transmission of desired sounds via modulated ultrasonic stimulation.

In one or more embodiments, as depicted in FIG. 31, an auditory signal may be received or captured, for example, by an input such as a microphone 318 (311). An envelope or fast temporal structure is obtained from the auditory signal (312), for example using a processor. In one or more embodiments, the envelope 315 (i.e., the line connecting the upper tips of the auditory signal 316) or other temporal features of the auditory signal 316 is extracted and used to modulate the frequency for the ultrasound carrier signal 317 (313). The modulated carrier signal is then sent to the transducer 319 (314). The transducer is used to deliver the ultrasonic signal to the patient.

Figure 32:
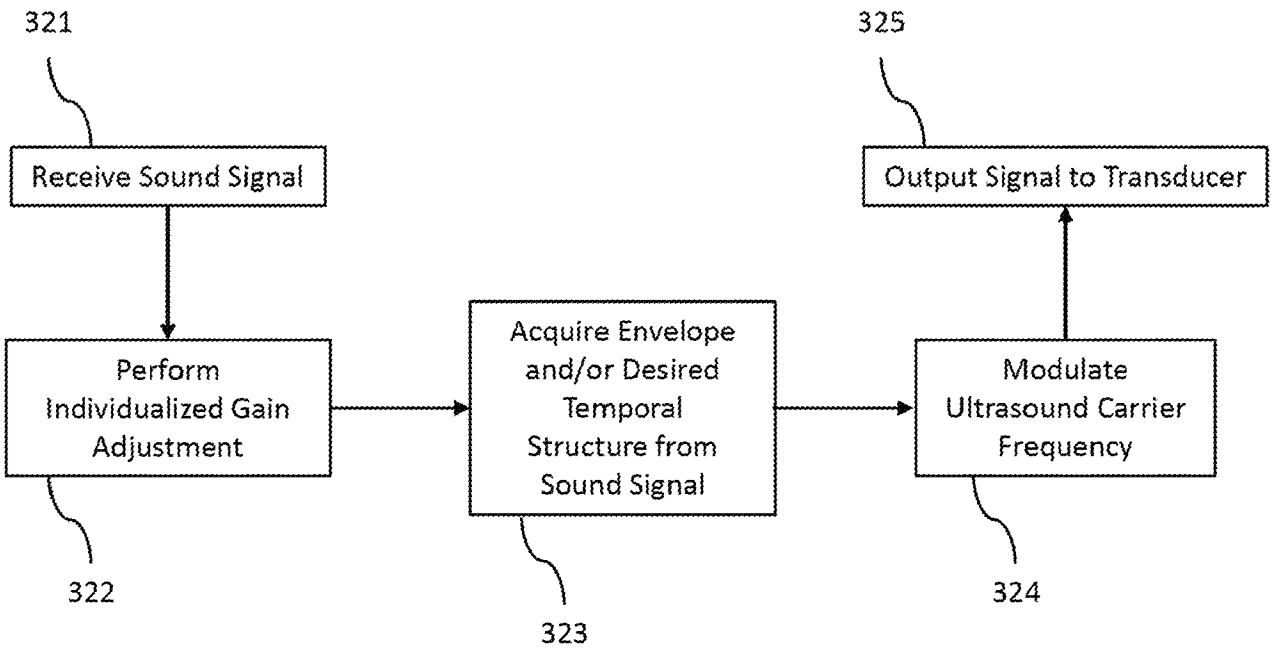
FIG. 32 is a flow chart of another example system and related method according to one or more embodiments, with individualized gain adjustment. Such a modified process could ensure that the ultrasonic stimulus is loud enough and adjusted to be heard as expected for natural audible sound stimulus.

FIG. 32 illustrates one or more related embodiments. An auditory signal is received and captured, for example, by an input such as a microphone (321). A gain adjustment is applied, and can be individualized (322). The gain adjustment could ensure that the ultrasound signal is heard as expected. An envelope or fast temporal structure is obtained from the auditory signal, for example, using a processor (323), similar to step (312) above. In one or more embodiments, the envelope or other temporal features of the auditory signal is extracted and used to modulate the carrier frequency of the ultrasound (324), similar to step (313)

above. The modulated carrier frequency is sent to the transducer (325), and the transducer is used to deliver the signal to the patient.

Figure 33:
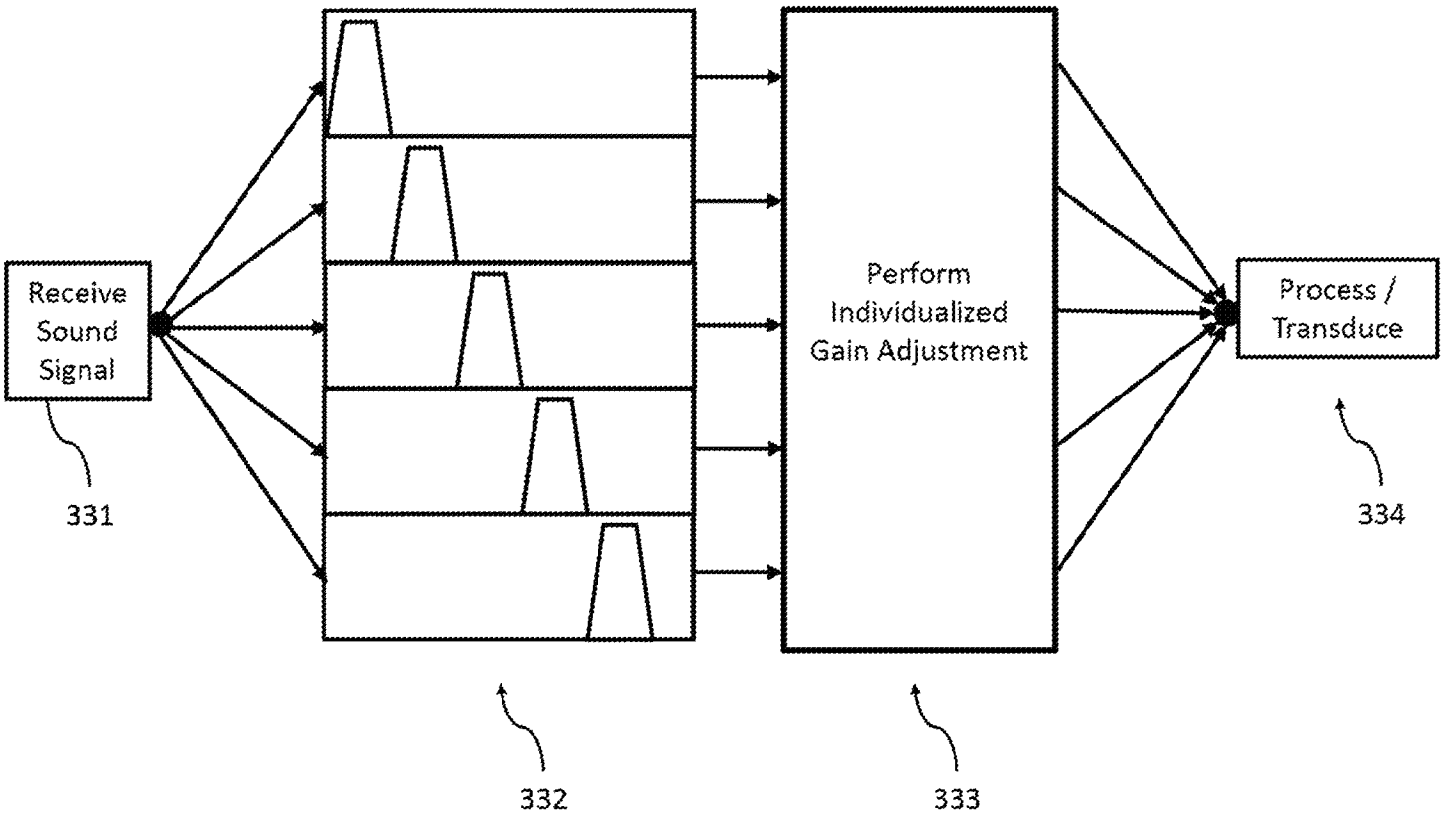
FIG. 33 is a flow chart of another example system and related method according to one or more embodiments, with audio signal split up into frequency bands using bandpass filters. This allows for individual gain adjustment based on frequency bands, such as frequency bands with corresponding structures that may be damaged in a given patient (i.e., frequency bands for which a patient has a hearing deficit) or frequency bands having interference from other ambient sound components that requires compensation for better hearing of desired sound components. The signals can then be reconstructed and used to modulate a carrier signal's frequency when delivered to the body using the transducer.

In one or more embodiments, as shown in FIG. 33, after the sound signal is received (331), the method includes splitting the audio signal into frequency bands using one or more bandpass filters (332). This allows for individual adjustments based on frequency bands. The signals can then be reconstructed and used to modulate the carrier frequency when sent to the transducer. The audio signal can be bandpass filtered into different pre-determined frequency ranges for different transducers in which those frequency ranges are sub-ranges between 20 Hz to 20 kHz. These modulation signals are used to modulate (for example, multiply with) the ultrasonic carrier frequency, selected from between 50 kHz to 4 MHz, for a given transducer. It is possible to present several carrier frequencies at the same time that are modulated by one of these pre-determined modulation signals or present just one carrier frequency to each transducer that is modulated by one of these pre-determined modulation signals in which we have multiple transducers to span all of the pre-determined modulation frequency ranges. Individualized gain adjustment (333) and processing and delivery through a transducer (334) may be performed in a manner similar to the above discussion.

Figure 34:
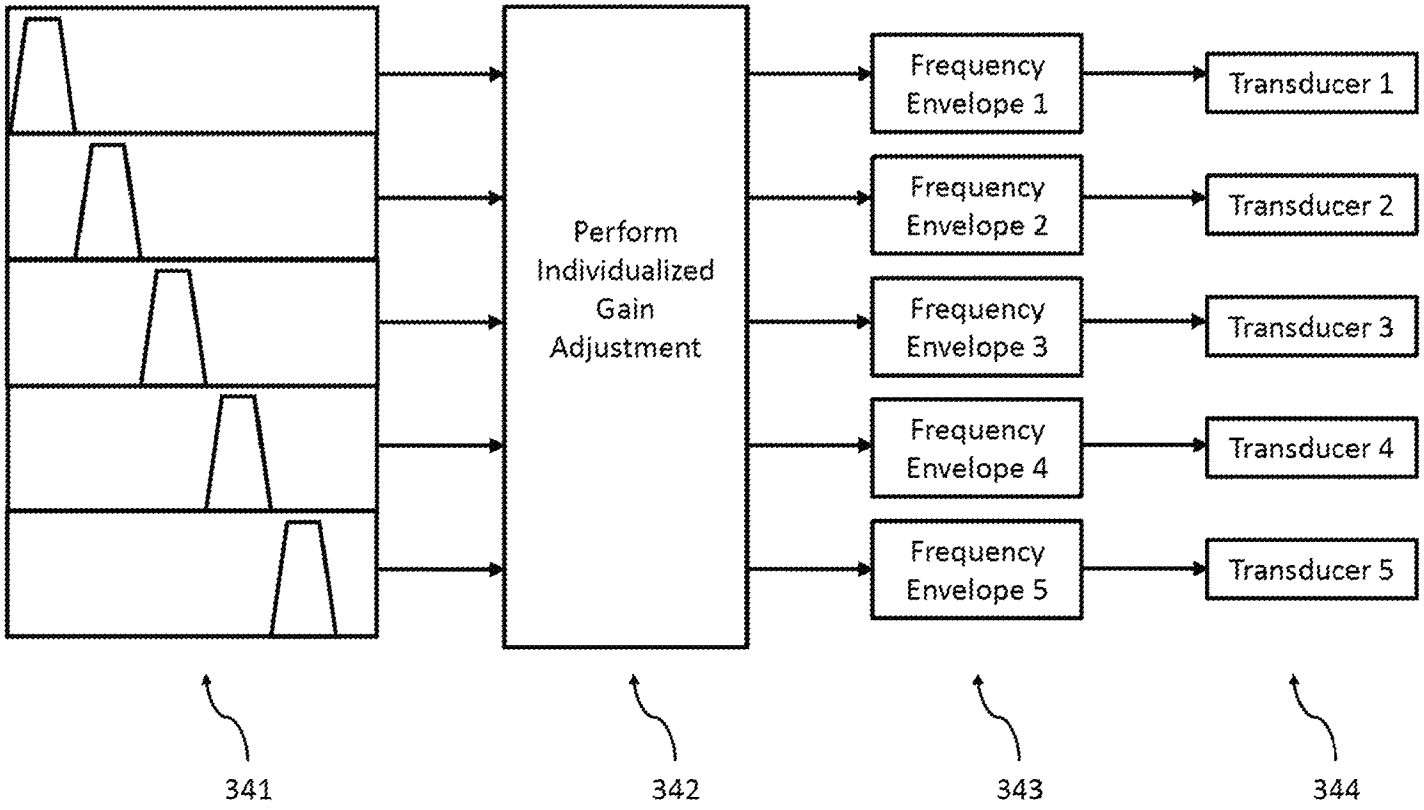
FIG. 34 is a flow chart of another example system and related method according to one or more embodiments, with different transducers selected/specified for different frequency bands. An array of transducers may be used, and the audio signal may be split up into frequency bands and each frequency band presented to the wearer via a separate transducer. Such a process can further individualize and customize based on frequency.

FIG. 34 illustrates the use of one or more transducers, such as an array of transducers, corresponding with different frequency envelopes. As above, after an audio signal is received, the audio signal is split up into frequency bands (341). Individualized gain adjustment may be performed (342), a set of frequency envelopes may be generated to correspond with the different modulation frequency bands (343). Each frequency band may be presented to the patient via separate transducers (344). This allows even further individualization and customization based on frequency.

Examples of the ultrasound hearing device described above are well-suited for individuals with hearing loss, but the ultrasound device can also be used with similar device components to provide different or enhanced hearing for those without any noticeable hearing loss. For example, the device could be used to listen to speech or music in a noisy environment that compromises normal hearing in various situations. Furthermore, the ultrasound hearing device could be used in consumer products such as cell phones, smartphones, music players, recorders or other devices in which sound is transmitted to the user. The sound information could already be recorded on the device or it could be transmitted to the device through a wired or wireless interface from another device that has a microphone sensing the sound signal elsewhere. The various algorithms described above can be used to enhance or improve the sound quality of specific temporal or spectral components in the desired acoustic signal that have experienced interference or distortion from the ambient or recorded environment.

It is to be understood that the above description is intended to be illustrative, and not restrictive. The present disclosure has described one or more preferred embodiments, and it should be appreciated that many equivalents, alternatives, variations, and modifications, aside from those expressly stated, are possible and within the scope of the invention. Other embodiments will be apparent to those of skill in the art upon reading and understanding the above description. It should be noted that embodiments discussed in different portions of the description or referred to in different drawings can be combined to form additional embodiments of the present application. The scope should, therefore, be determined with reference to the appended claims, along with the full scope of equivalents to which such claims are entitled.

The invention claimed is:

1. A hearing system for stimulating an auditory system for sound perception that bypasses middle ear bones, the system comprising:

an ultrasonic transducer configured to deliver a modulated ultrasound signal via an interface medium and a processor communicatively coupled with the ultrasonic transducer, the processor being configured to:

receive an audio signal and extract temporal and spectral features from the audio signal;

generate, based on the extracted temporal and spectral features of the audio signal, a modulated ultrasound signal using a carrier signal having one frequency or multiple frequencies between 100 kHz and 4 MHz;

perform ramping on the modulated ultrasound signal to control at least one of temporal or frequency activation effects; and provide the modulated and ramped ultrasound signal to the ultrasonic transducer for delivery via an interface medium, wherein the ultrasonic transducer is positioned on a user's body to deliver the modulated and ramped ultrasound signal to the user.

2. The hearing system of claim 1, wherein perception of sounds in the audio signal results from vibration of cochlear fluids via vibration of cerebrospinal fluids.

3. The hearing system of claim 1, further including a sound sensor configured to capture ambient sounds and generate the audio signal received by the processor.

4. The hearing system of claim 1, wherein the ultrasonic transducer includes multiple transducers configured to be positioned at multiple locations on a user's head.

5. The hearing system of claim 1, wherein the ultrasonic transducer is part of an array of transducers.

6. The hearing system of claim 5, wherein each transducer in the array of transducers is configured to receive the modulated ultrasonic signal within a predetermined frequency range, wherein the predetermined frequency ranges of two of the transducers are at least partly non-overlapping.

7. The hearing system of claim 1, wherein the processor is configured to extract the temporal and spectral features from the audio signal in a frequency range of 20 Hz to 20 kHz, and wherein the carrier signal used to generate the modulated ultrasound signals is modulated by the extracted temporal and spectral features of the audio signal.

8. The hearing system of claim 1, wherein the transducer comprises an interface medium having one or more of an elongated gel-filled tube, fluid-filled tube, and a solid flexible tube, and wherein the interface medium extends from a first end to a second end, the first end being coupled with the transducer and the second end being at least partly exposed for coupling with a portion of the user's body.

9. The hearing system of claim 8, wherein the second end is configured to be disposed within an ear to deliver the modulated ultrasound signal and generate cochlear vibrations via vibrations in cerebrospinal fluid.

10. The hearing system of claim 1, configured such that when the transducer is coupled to a neck, a chest, a back, or a stomach of the user's body to deliver the modulated ultrasound signal to the user, cochlear fluids are vibrated via vibration of the cerebrospinal fluid in the user's body.

11. The hearing system of claim 1, further comprising a left transducer configured to be secured to a left side of the user's body, and a right transducer configured to be secured to a right side of the user's body, wherein the processor is configured to use both the left and the right transducers to deliver the modulated ultrasonic signal.

12. A method for stimulating an auditory system for sound perception via cerebrospinal fluids, the method comprising:

receiving audio signals with sounds to be perceived by a user;

extracting temporal and spectral features from the received audio signals;

generating modulated ultrasound signals by modulating carrier signals based on the extracted temporal and spectral features, wherein the carrier signals have a frequency within a range of 100 kHz to 4 MHz;

perform ramping on the modulated ultrasound signal to control at least one of temporal or frequency activation effects; and delivering the modulated and ramped ultrasound signals to the user using one or more ultrasonic transducers in contact with one or more portions of the user's body.

13. The method of claim 12, wherein the carrier signals have a frequency within a range of 100 kHz to 1 MHz.

14. The method of claim 12, further comprising filtering the audio signals with at least one bandpass filter to generate filtered signals.

15. The method of claim 14, further comprising amplifying the filtered signals and compressing the filtered signals to compensate for frequency-specific hearing deficits or interference in specific frequency components from the surrounding acoustic environment.

16. The method of claim 15, further comprising reconstructing each filtered signal to a time-domain signal.

17. The method of claim 16, further comprising using the time-domain signal to modulate the ultrasound carrier signal.

18. The method of claim 17, wherein the ultrasound carrier is one frequency or multiple frequencies between 100 kHz to 1 MHz or 50 kHz to 4 MHz.

19. The method of claim 12, wherein delivering the modulated ultrasound signals to the user using one or more ultrasonic transducers comprises delivering modulated ultrasound signals within different frequency ranges to different ultrasonic transducers in an array of ultrasonic transducers.

20. The method of claim 12, further comprising coupling the medium to one or more skull regions of asterion, pterion, bregma, lambda, and zygomatic arch.

21. The method of claim 12, wherein the ultrasonic transducers contact the body via an interface medium, and wherein the method further comprises placing the at least one transducer and the interface medium in two or more different locations of the body.

22. A hearing system for stimulating an auditory system via cerebrospinal fluids, the system comprising:

a sound sensor configured to capture ambient sounds and generate an audio signal corresponding with the ambient sounds;

an array of ultrasonic transducers configured to deliver modulated ultrasound signals to a user's body with a power transfer of no more than 500 $mW/cm^2$ to the user's body; and a processor communicatively coupled with the sound sensor and the array of ultrasonic transducers, the processor being configured to:

extract temporal and spectral features from the audio signal generated by the sound sensor;

generate, based on the extracted temporal and spectral features of the audio signal, modulated ultrasound signals using carrier signals having frequencies ranging from 100 kHz to 4 MHz; and provide modulated ultrasound signals to selected ultrasonic transducers in the array based on frequency, such that each ultrasonic transducer is provided a modulated ultrasonic signal within a predetermined frequency range.

* * * * *